US008783268B2

(12) United States Patent
Gueret

(10) Patent No.: US 8,783,268 B2
(45) Date of Patent: Jul. 22, 2014

(54) APPLICATOR FOR COMBING THE EYELASHES OR THE EYEBROWS, OR FOR APPLYING A COMPOSITION THERETO

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 170 days.

(21) Appl. No.: 13/001,517

(22) PCT Filed: Jul. 16, 2009

(86) PCT No.: PCT/IB2009/053100

§ 371 (c)(1),
(2), (4) Date: Mar. 17, 2011

(87) PCT Pub. No.: WO2010/007588

PCT Pub. Date: Jan. 21, 2010

(65) Prior Publication Data

US 2011/0168204 A1 Jul. 14, 2011

Related U.S. Application Data

(60) Provisional application No. 61/157,213, filed on Mar. 4, 2009, provisional application No. 61/091,947, filed on Aug. 26, 2008.

(30) Foreign Application Priority Data

Jul. 16, 2008 (FR) ..... 08 04060

(51) Int. Cl.
*A45D 40/26* (2006.01)
*A46B 9/02* (2006.01)

(52) U.S. Cl.
CPC ..... *A45D 40/262* (2013.01); *A46B 9/021* (2013.01)
USPC ..... 132/218; 132/320

(58) Field of Classification Search
CPC ..... A45D 40/262; A45D 40/265; A46B 9/02; A46B 9/021; A46B 2200/1046; A46B 2200/1053; A46B 2200/106
USPC ..... 132/218, 159, 160, 161, 901, 317, 318, 132/320, 216, 217; 401/126, 129, 118, 261, 401/122; 15/206, 207.2, 207, 160
See application file for complete search history.

(56) References Cited

U.S. PATENT DOCUMENTS 2,975,452 A * 3/1961 Doull et al. ..... 15/209.1
3,921,650 A 11/1975 Montgomery (Continued)

FOREIGN PATENT DOCUMENTS

CN 1187964 A 7/1998
CN 1368858 A 9/2002

(Continued)

OTHER PUBLICATIONS

International Search Report in International Application No. PCT/IB2009/053100; dated May 6, 2010.

(Continued)

*Primary Examiner* — Vanitha Elgart
(74) *Attorney, Agent, or Firm* — Oliff PLC

(57) ABSTRACT

An applicator for combing keratinous fibers, in particular eyelashes and/or eyebrows, and/or for applying a composition on the keratinous fibers, in particular the eyelashes and/or the eyebrows, the applicator including a molded applicator member that includes a core having a longitudinal axis; and teeth extending outwards from the core, at least one tooth extending towards the front and at least one tooth extending towards the rear of the applicator; the core presenting a greatest transverse dimension measured perpendicularly to its longitudinal axis, that is less than or equal to the greatest length of the teeth.

15 Claims, 22 Drawing Sheets

(56) References Cited

U.S. PATENT DOCUMENTS

| | | | | | |
|---|---|---|---|---|---|
| 4,422,986 | A * | 12/1983 | Cole | 264/39 |
| 4,545,393 | A | 10/1985 | Gueret et al. | |
| 4,635,659 | A | 1/1987 | Spatz | |
| 4,993,438 | A | 2/1991 | Hunt | |
| 4,993,440 | A * | 2/1991 | Gueret | 132/218 |
| 5,357,987 | A * | 10/1994 | Schrepf | 132/218 |
| 5,876,138 | A * | 3/1999 | Gueret | 401/129 |
| 5,937,870 | A | 8/1999 | Gueret | |
| 6,189,540 | B1 | 2/2001 | Stovall et al. | |
| 6,295,994 | B1 | 10/2001 | Thayer et al. | |
| 6,328,495 | B1 | 12/2001 | Gueret | |
| 6,343,607 | B1 * | 2/2002 | Gueret | 132/218 |
| 6,375,374 | B2 | 4/2002 | Gueret | |
| 6,450,177 | B1 * | 9/2002 | Christoforu et al. | 132/218 |
| 6,539,950 | B1 * | 4/2003 | Gueret | 132/218 |
| 6,616,366 | B1 * | 9/2003 | Weihrauch | 401/286 |
| 7,325,550 | B2 * | 2/2008 | Eckers et al. | 132/218 |
| D592,858 | S * | 5/2009 | Berhault | D4/128 |
| D600,921 | S * | 9/2009 | Berhault | D4/128 |
| D633,305 | S * | 3/2011 | Pires et al. | D4/128 |
| D639,564 | S * | 6/2011 | Kulik | D4/128 |
| 8,042,554 | B2 * | 10/2011 | Dumler | 132/218 |
| 8,056,569 | B2 * | 11/2011 | Berhault | 132/218 |
| 8,096,306 | B2 * | 1/2012 | Malvar et al. | 132/218 |
| 2001/0010227 | A1 | 8/2001 | Dumler | |
| 2004/0258453 | A1 | 12/2004 | Gueret | |
| 2005/0028834 | A1 | 2/2005 | Ramet | |
| 2005/0034740 | A1 * | 2/2005 | Eckers et al. | 132/218 |
| 2005/0175394 | A1 | 8/2005 | Gueret | |
| 2006/0162736 | A1 * | 7/2006 | Gray | 132/218 |
| 2007/0033759 | A1 * | 2/2007 | Dumler | 15/187 |
| 2007/0033760 | A1 * | 2/2007 | Dumler | 15/187 |
| 2007/0246058 | A1 * | 10/2007 | Bodelin | 132/218 |
| 2008/0011317 | A1 * | 1/2008 | Malvar et al. | 132/218 |
| 2008/0023020 | A1 * | 1/2008 | Gueret | 132/218 |
| 2008/0115798 | A1 * | 5/2008 | Rainey et al. | 132/218 |
| 2008/0142034 | A1 * | 6/2008 | Manici et al. | 132/218 |
| 2008/0202546 | A1 * | 8/2008 | Keurinck | 132/218 |
| 2008/0245382 | A1 * | 10/2008 | Marciniak-Davoult et al. | 132/200 |
| 2009/0014022 | A1 * | 1/2009 | Salciarini | 132/200 |
| 2009/0065020 | A1 * | 3/2009 | Butcher et al. | 132/218 |
| 2011/0297174 | A1 * | 12/2011 | Ornoski et al. | 132/218 |
| 2012/0199158 | A1 * | 8/2012 | Bickford | 132/218 |

FOREIGN PATENT DOCUMENTS

| | | | |
|---|---|---|---|
| CN | 1141897 | C | 3/2004 |
| EP | 1 342 428 | A1 | 9/2003 |
| EP | 1 611 817 | A1 | 1/2006 |
| EP | 1 935 279 | A1 | 6/2008 |
| FR | 2 564 712 | A1 | 11/1985 |
| FR | 2 906 115 | A1 | 3/2008 |
| WO | WO 2006/039575 | A1 | 4/2006 |
| WO | WO 2006/090343 | A1 | 8/2006 |
| WO | WO 2006/111645 | A1 | 10/2006 |
| WO | WO 2006/124228 | A1 | 11/2006 |
| WO | WO 2006/125122 | A1 | 11/2006 |
| WO | WO 2007/007449 | A1 | 1/2007 |

OTHER PUBLICATIONS

Written Opinion of the International Searching Authority in International Application No. PCT/IB2009/053100; dated May 6, 2010.

Office Action issued in Chinese Application No. 200980127985.1 dated Sep. 24, 2012 (w/ English Translation).

* cited by examiner

APPLICATOR FOR COMBING THE EYELASHES OR THE EYEBROWS, OR FOR APPLYING A COMPOSITION THERETO

This application claims priority from French patent application Ser. No. 08/04060 filed on Jul. 16, 2008, and provisional U.S. application No. 61/091,947 filed on Aug. 26, 2008, and No. 61/157,213 filed on Mar. 4, 2009.

BACKGROUND

The present invention relates to an applicator for combing human keratinous fibers, in particular the eyelashes and/or the eyebrows, and/or for applying a cosmetic composition, makeup, or a care product thereto, e.g. mascara or a hair-coloring composition.

The invention also relates to a packaging and applicator device including such an applicator.

The invention also applies to a method of cosmetic treatment.

Application WO 2006/111645 discloses a mascara brush including bristles extending over more than 230° around the core.

Applicators are known for applying mascara to the eyelashes, comprising an applicator member molded with a core and teeth disposed around the core and projecting outwards from the core.

Patent application FR 2 906 115, U.S. Pat. No. 4,635,659, and international applications WO 2006/124228 and WO 2006/125122 disclose mascara applicators having teeth oriented towards the front or towards the rear of the applicator, which teeth are of length that is clearly shorter than the local diameter of the core.

U.S. Pat. No. 3,921,650 discloses a mascara applicator having teeth that extend towards the front, which teeth are short relative to the core.

Patent application FR 2 564 712 describes a mascara applicator having bristles that extend axially at one of its ends.

In application EP 1 342 428, the diameter of the core is not disclosed.

In U.S. Pat. No. 4,545,393, the set of teeth extends perpendicularly to the longitudinal axis of the core.

There exists a need to benefit from an applicator that enables novel makeup effects to be achieved on the hair, the eyelashes, or the eyebrows, whether or not they are already coated in a composition, that is easy to use and that improves the application of the composition, the covering of the hair, the eyelashes, or the eyebrows with composition, and the lengthening and the separation thereof.

SUMMARY

Exemplary embodiments of the present invention thus provide an applicator for combing keratinous fibers, in particular eyelashes and/or eyebrows, and/or for applying a composition on the keratinous fibers, in particular the eyelashes and/or the eyebrows, the applicator including a molded applicator member that comprises:

- a core having a longitudinal axis;
- teeth extending outwards from the core, the core presenting a greatest transverse dimension measured perpendicularly to its longitudinal axis, that is less than or equal to the greatest length of the teeth;
- at least one tooth extending towards the front and at least one tooth extending towards the rear of the applicator; and/or
- at least one tooth extending perpendicularly to the longitudinal axis of the core and at least one tooth extending towards the front or towards the rear in oblique manner, at least one tooth extending from its base towards its free end, and the length of the core on which the teeth extend being greater than the greatest transverse dimension of the envelope surface of the applicator member.

The term "towards the front" should be understood as being towards the distal end of the applicator, and the term "towards the rear" should be understood as being towards the proximal end of the applicator.

In addition, the teeth that extend "towards the front" respectively "towards the rear" may present inclinations starting from their bases towards the front respectively towards the rear. Below, the term "at the front" is used to mean on the side of the distal end and the term "at the rear" is used to mean on the side of the proximal end.

The term "in oblique manner" should be understood as meaning that the teeth make a non-zero angle other than 90° relative to the longitudinal axis of the core, for example an angle lying in the range 10° to 80°. The angle is defined between the direction of elongation of the tooth and the longitudinal axis of the core.

The term "from its base towards its free end" should be understood as meaning that the tooth may present a single base from which it extends towards its free end.

Preferably, most, or even all, of the teeth extend from their bases towards their free end.

The applicator according to exemplary embodiments of the invention may have teeth that are relatively long and a core that may have a maximum transverse dimension that is quite small, thus enabling it to be made supple and flexible and contributing to making application gentle and comfortable while nevertheless ensuring that the eyelashes or the eyebrows are lengthened and separated in satisfactory manner. Composition may thus be applied precisely.

In the invention, the teeth of the applicator member do not all extend perpendicularly to the longitudinal axis of the core.

The term "longitudinal axis of the core" should be understood as being the line interconnecting the centers of gravity of the cross-sections of the core. In certain circumstances, the longitudinal axis may be central axis, and even an axis of symmetry of the core, particularly when the core presents a cross-section that is generally in the form of a regular polygon or a circle. The longitudinal axis of the core may be straight or curvilinear. The longitudinal axis of the core may be contained in a midplane of the core. With respect to the core the term "midplane" should be understood as being a plane that contains the centers of gravity of the cross-sections of the core and that may be a plane of symmetry in some or even all of the cross-sections of the core.

The term "tooth" should be understood as designating an individualizable projecting element for engaging the eyelashes, such that this term is synonymous with "bristle" in the context of the present invention.

The term "length of a tooth" should be understood as designating the distance measured along the direction of elongation of the tooth between the free end of the tooth and its base that connects the tooth to the core. The length of a tooth is the visible length of the tooth measured from the core of the applicator member.

The term "greatest length of the teeth" should be understood as the length of the longest tooth, measured from the core and along the direction of elongation of said tooth going from the core.

The term "length of the core over which the teeth extend" should be understood as the length measured along the longitudinal axis of the core between the base of the tooth nearest the proximal end and the base of the tooth nearest the distal end.

The term "envelope surface of the applicator member" is defined by the free ends of its teeth.

By way of example, the greatest transverse dimension of the applicator member lies in the range 9 millimeters (mm) to 14 mm, and it may be less than or equal to 6 mm.

In exemplary embodiments of the invention, the applicator member is entirely molded. It should be understood that the applicator member is molded entirely out of one or more thermoplastic materials, thus excluding in particular that it includes any metal portion.

The greatest length of at least one tooth, and preferably of at least the majority of the teeth may be greater than or equal to 1.1 times or 1.2 times the greatest transverse dimension of the core, better 1.5 times or 2 times or 2.5 times or better still 3 times said greatest transverse dimension of the core.

In addition, the length of the core over which the teeth extend may be greater than or equal to 1.1, 1.2, 1.3, 1.4, or 1.5 times the greatest transverse dimension of the envelope surface of the applicator member, or indeed 2 or 2.5 or even 3 times said dimension.

In exemplary embodiments of the invention, the length over which the teeth extending perpendicularly to the longitudinal axis of the core extend is greater than or equal to 1.1, 1.2, 1.3, 1.4, or 1.5 times the length over which the teeth extending towards the front or towards the rear extend, or indeed 2, or 2.5, or even 3 times said length.

Independently or in combination with the above, other exemplary embodiments of the invention also provide an applicator for combing keratinous fibers, in particular eyelashes and/or eyebrows, and/or for applying a composition on the keratinous fibers, in particular the eyelashes and/or the eyebrows, the applicator including a molded applicator member that comprises:

a core having a longitudinal axis; and teeth extending outwards from the core, at least one tooth extending towards the front and at least one tooth extending towards the rear of the applicator; and/or at least one tooth extending perpendicularly to the longitudinal axis of the core and at least one tooth extending towards the front or towards the rear in oblique manner, at least one tooth extending from its base towards its free end, and the length of the core on which the teeth extend being greater than the greatest transverse dimension of the envelope surface of the applicator member;

the teeth including at least one row of teeth disposed in alternation on either side of an unmolding plane for the row, e.g. as described in patent application EP 1 611 817, the content of which is incorporated herein by reference.

By way of example, each of the teeth of the row is disposed entirely on one side only of the unmolding plane.

At least some of the teeth of the row may have a plane longitudinal surface that extends parallel to the unmolding plane.

Independently or in combination with the above, other exemplary embodiments of the invention also provide an applicator for combing keratinous fibers, in particular eyelashes and/or eyebrows, and/or for applying a composition on the keratinous fibers, in particular the eyelashes and/or the eyebrows, the applicator including a molded applicator member that comprises:

a core having a longitudinal axis; and teeth extending outwards from the core; at least three teeth or four teeth, better five teeth, extending in respective directions of elongation, each making an angle with the longitudinal axis of the core, said angle having a different value for each of said teeth. The angle may vary progressively or remain constant over a portion of the core on going along the longitudinal axis of said core. When the longitudinal axis of the core is curved, the angle is measured relative to the tangent to the longitudinal axis at the point of intersection with the direction of elongation of the tooth, or in an orthogonal projection plane if there is no point of intersection, and regardless of whether the longitudinal axis is rectilinear or curved.

In other exemplary embodiments, the invention provides a packaging and applicator device comprising:

an applicator comprising a molded applicator member having a length and defining an envelope surface of varying transverse section that passes through at least one maximum, said applicator member comprising:

a core having a longitudinal axis;

teeth extending outwards from the core, the core having a greatest transverse dimension measured perpendicularly to its longitudinal axis that is less than or equal to a greatest length of the teeth;

at least one tooth extending towards the front and at least one tooth extending towards the rear of the applicator; and/or at least one tooth extending perpendicularly to the longitudinal axis of the core and at least one tooth extending towards the front or towards the rear in oblique manner, at least one tooth extending from its base towards its free end, and the length of the core over which the teeth extend being greater than the greatest transverse dimension of the envelope surface of the applicator member; and a container containing a composition for application to human keratinous fibers, in particular the eyelashes or the eyebrows, the container defining an inside space containing the composition, said space being of a height that is at least twice the length of the applicator member;

the maximum cross-section of the envelope surface of the applicator member occupying at least 70% of the inside section of the container, i.e. the inside section of the inside space containing the composition, at least along a fraction of the path traveled by the applicator member while it is being extracted from the container and under the wiper member, the height of this fraction being not less than twice the length of the applicator member, e.g. lying in the range two to ten times the length of the applicator member.

The length of the applicator member is defined by the "length of the core over which the teeth extend", as defined above.

The height of the inside space of the container corresponds to the distance measured between the bottom of the container and the outlet orifice.

The term "fraction of the container along which the applicator member travels" should be understood as a fraction of the container that comes into register with the applicator member while it moves from its storage position towards a position outside the container.

In these other exemplary embodiments, the invention makes it possible, for equal content, to increase the number of applications, or for identical number of applications, to decrease the quantity of composition initially present in the container. This result may be obtained without an expensive construction for the container and while allowing the container to retain, if so desired, the appearance of conventional containers. For example, for a container having a capacity of 6 milliliters (mL), it is possible to put in 3.5 mL to 4 mL of composition. The quantity of composition present in the container may be greater than the volume defined by the envelope surface of the applicator member.

The extraction rate may be increased compared with known devices, for example it may be greater than or equal to 60%, better 70%, or even 80% or 90%.

The quantity of composition on the applicator member on each extraction from the container may be relatively constant, because of the wiping and because the applicator member stirs the composition in the container. The texture of the composition may also be relatively constant, because it is homogenized.

These exemplary embodiments of the invention may also serve to reduce the dead volume of composition present in the bottom of the container, thereby further reducing the quantity of composition that remains unused. The bottom of the container may advantageously present a shape that fits substantially around the shape of the applicator member.

These exemplary embodiments of the invention may also improve the way in which the applicator member is impregnated with composition on first insertion into the container, by making it easier for the composition to pass through the applicator member.

In spite of the small spacing, or even contact, between the applicator member and the inside surface of the container over the fraction of the container along which the applicator member travels, it is nevertheless possible for the applicator member to move within the container without the composition opposing too much resistance to the movement of the applicator member, because of the non-constant shape of the cross-section of the envelope surface of the applicator member. In particular, the peripheral region of the applicator member closest to the inside surface of the container may be relatively short, and thus relatively easy for the composition to pass through.

The region of the applicator member that is situated at a short distance from the inside surface of the side wall of the container along which the applicator member travels may for example be less than 1.5 mm therefrom, better less than 1 mm or 0.5 mm. It may be of length that is less than or equal to 5 mm, as measured along the axis of the applicator member.

The greatest transverse dimension of the envelope surface of the applicator member may for example be at least 0.85 times the inside diameter of the container in its fraction along which the applicator member travels, ignoring the neck, and better at least 0.90 or even 0.95 times said diameter.

The greatest transverse dimension of the applicator member may also be equal to or greater than the inside diameter of the container along the fraction traveled by the applicator member other than in the neck, the greatest transverse dimension being greater than the greatest inside diameter of the container by a factor lying in the range 1 to 1.15 times, for example.

The inside diameter of the container may be at a maximum in the fraction of the container along which the applicator member travels.

Outside the region of the applicator member that is close to the inside surface of the side wall of the container, the envelope surface of the applicator member may be spaced away by more than 0.075 times the greatest inside diameter of the side wall of the container, this spacing corresponding for example to a distance of more than 1.5 mm.

The fraction of the container, other than the neck, where the applicator member may move at zero or small distance from the inside surface of the container, e.g. with $|Dr-Db|<3$ mm, better 2 mm, better still 1.5 mm or 0.5 mm, preferably extends over the major portion of the height of the inside space of the container, and preferably at least in part in the bottom half of the container. Dr is the greatest inside diameter of the container in its fraction along which the applicator member travels, below the neck, if any, and Db is the greatest transverse dimension of the applicator member. It is possible for $Db \leq Dr$ or for $Db > Dr$, i.e. the applicator member may rub against the inside surface of the container.

The applicator member may travel over at least three times its own length while being extracted from the container.

The dead volume of composition, defined by the volume outside the applicator member but inside the container, over the segment of the container that extends axially between the end of the container and the proximal end of the applicator member when the applicator member is in its storage position in the container may be less than or equal to the volume of the applicator member, e.g. less than or equal to ¾ of this volume, or even ½ of this volume. The term "volume of the applicator member" is used to designate the volume defined by its envelope surface.

In all of the above exemplary embodiments of the invention, the teeth may present orientations that vary as measured relative to the longitudinal axis of the core. When the applicator member is observed perpendicularly to the longitudinal axis of the core, teeth may be configured in a fan, in a half-fan towards the front, in a half-fan towards the rear, or in an asymmetrical fan, or in multiple fans.

The term "teeth configured in a fan" is used to designate a set of teeth having directions of elongation that form angles with the longitudinal axis of the core, as measured relative thereto, in the range 0° to 90° (limits included), such that on going towards the distal end these angles begin by increasing and continue by decreasing. In the particular configuration of the fan having only two teeth, there is one tooth extending towards the front followed consecutively by another tooth extending towards the rear on going along the longitudinal axis of the core. In the particular configuration of the fan having only three teeth, there are two teeth extending towards the front and one tooth towards the rear or two teeth extending towards the rear and one tooth towards the front. The number of teeth is preferably greater than three.

The term "teeth configured in a half-fan towards the front" designates a set of teeth having directions of elongation forming angles relative to the longitudinal axis of the core, as measured relative thereto, in the range 0° to 90° (limits included), that decrease on going towards the distal end.

the term "teeth configured in a half-fan towards the rear" designates a set of teeth having directions of elongation forming angles with the longitudinal axis of the core, measured relative thereto, in the range 0° to 90° (limits included), that increase on going towards the distal end.

Thus, the succession along the longitudinal axis of the core of a configuration forming a half-fan towards the front and a configuration forming a half-fan towards the rear gives a configuration forming a fan.

The term "teeth configured in an asymmetrical fan" means a set of teeth in a fan configuration in which the half-fan subset towards the front and the half-fan subset towards the rear are not symmetrical to each other about a mid plane perpendicular to the core, e.g. because they extend over lengths that are different when measured along the longitudinal axis of the core.

The term "teeth configured in a multiple fan" is used to mean juxtaposing at least two sets of teeth in fan configurations along the longitudinal axis of the core. Under such circumstances, the envelope surface may for example have an undulating profile with a cross-section that passes through maxima and minima, including at least one relative minimum. For example, when there are two sets of teeth in a fan configuration juxtaposed along the longitudinal axis of the core, the envelope surface may for example be peanut-shaped.

By way of example, a fan configuration may encourage penetration of the teeth of the applicator into the row of eyelashes and thus comb them while covering them in composition.

On moving along the longitudinal axis of the core, the acute angle formed between the direction of elongation to the teeth and the longitudinal axis of the core may increase and then decrease. For example, it may increase from 0° to 90°, and then decrease towards 0°.

The applicator may include at least one tooth for the angle has a value lying in the range 0° to 5°, and/or at least one tooth for which the angle has a value lying in the range 5° to 10°, and/or at least one tooth for which the angle has a value lying in the range 10° to 20°, and/or at least one tooth for which the angle has a value lying in the range 20° to 30°, and/or at least one tooth for which the angle has a value lying in the range 30° to 40°, and/or at least one tooth for which the angle has a value lying in the range 40° to 50°, and/or at least one tooth for which the angle has a value lying in the range 50° to 60°, and/or at least one tooth for which the angle has a value lying in the range 60° to 70°, and/or at least one tooth for which the angle has a value lying in the range 70° to 80°, and/or at least one tooth for which the angle has a value lying in the range 80° to 90°.

The angle formed between the respective directions of elongation of two teeth that are in succession along the longitudinal axis of the core may be substantially zero or lie in the range 2° to 30°, or in the range 5° to 25°, better in the range 7° to 20°, for example.

In other exemplary embodiments, it is possible to have much greater angular differences, e.g. one tooth towards the front located consecutively with one tooth towards the rear on going along the longitudinal axis of the core.

The applicator may include a row of teeth having at least two teeth with orientations towards the front that are different and at least two teeth with orientations towards the rear that are different, the orientations being measured relative to the longitudinal axis of the core.

The applicator may include a row of teeth with at least two teeth having orientations towards the front that are different and at least one tooth extending perpendicularly relative to the longitudinal axis of the core, the orientations being measured relative to the longitudinal axis of the core.

The applicator may include a row of teeth with at least two teeth having orientations towards the rear that are different, and at least one tooth extending perpendicularly relative to the longitudinal axis of the core.

In addition, the applicator may include, on one side of the core, at least one tooth that extends perpendicularly to the longitudinal axis of the core, and on an opposite side of the core, at least one tooth that extends towards the front and at least one tooth that extends towards the rear.

Furthermore, the applicator may include on one side of the core, teeth that are disposed in a half-fan configuration towards the front and at least one tooth perpendicular to the longitudinal axis of the core, and on an opposite side of the core, teeth disposed in a half-fan configuration towards the rear together with at least one tooth perpendicular to the longitudinal axis of the core. Under such circumstances, the teeth disposed in a half-fan configuration towards the front or towards the rear and the teeth perpendicular to the longitudinal axis of the core may be situated close to the distal end or to the proximal end.

Thus, at least one tooth, or several teeth, of the applicator may extend perpendicularly to the longitudinal axis of the core. For example, all of the teeth situated on the core at the same abscissa position along the longitudinal axis of the core, or all of the teeth situated on the core between a first abscissa position and a second abscissa position, e.g. in a middle portion of the applicator, or between the proximal end and a first abscissa position or between a first abscissa position and the distal end, may be perpendicular to the longitudinal axis of the core.

The invention enables an applicator to be provided having one or more teeth at its free ends, unlike a conventional twisted brush, which cannot have bristles at its free end, given the twisted structure of the core.

The applicator may include a tooth that extends parallel to the longitudinal axis of the core, or that has an direction of elongation that coincides therewith. By way of example, this tooth may be disposed at a distal end of the core, remote from the proximal end of the core whereby the core is attached to a stem of the applicator.

Such a shape for the applicator may make it easier to insert it in a container containing the composition and may improve the precision with which the composition is applied, e.g. in the corner of the eye.

In other exemplary embodiments of the invention, the center of the base of the tooth closest to the distal end is situated at least 0.50 mm, or 0.60 mm, 1 mm, 1.50 mm, 2 mm, 2.50 mm, or 3 mm from the distal end. This tooth may be oriented either towards the front or towards the rear or it may be perpendicular to the longitudinal axis of the core.

The core may have a greatest transverse dimension, measured perpendicularly to its longitudinal axis, that is constant over at least a major fraction of its length, e.g. over two-thirds or three-fourths thereof, or over its entire length. The length of the core is measured along its longitudinal axis.

The length of the core may be measured between the bases of the extreme teeth that are respectively the tooth closest to the distal end and the tooth closest to the proximal end of the applicator.

A greatest transverse dimension of the core may lie in the range 1.5 millimeters (mm) to 3 mm, or in the range 2 mm to 3 mm, for example.

The core may have a length that is less than or equal to 25 mm, or less than or equal to 20 mm.

Furthermore, the length of the core over which the teeth extend, as measured along the longitudinal axis of the core, may lie in the range 6 mm to 25 mm, or 7 mm to 24 mm, 8 mm to 23 mm, 9 mm to 22 mm, 10 mm to 21 mm, 14 mm to 21 mm, or 16 mm to 21 mm.

The core may have a cross-section, taken perpendicularly to its longitudinal axis, that is of a shape that is constant on moving along the longitudinal axis of the core, e.g. over at least half of its length, or three-fourths of its length, or along its entire length.

The shape of the cross-section of the core may for example be selected from the following list, which list is not limiting: circular, oval, elliptical, oblong, triangular, square, rectangular, pentagonal, hexagonal, and octagonal.

The cross-section may be of shape that is polygonal, regular or otherwise, preferably regular, with sides that correspond to the longitudinal faces of the core being straight or possibly slightly concave or convex.

The core may present a cross-section that is not circular over the major fraction of its length.

The core may optionally be in the form of a body of revolution. The core need not be spherical. The core need not have any portions in relief other than the teeth.

Over at least a fraction of their lengths, the core and/or regions of the core may present cross-sections of shape that is selected from the following list: circular, semi-circular, elliptical, semi-elliptical, polygonal, triangular, square, rectangular, pentagonal, hexagonal, octagonal, and semi-polygonal. This shape may vary on moving along the longitudinal axis of the core.

The invention also provides an applicator wherein the ratio of a greatest transverse dimension of a first region of the core over a greatest transverse dimension of a second region of the core lies in the range 0.5 to 2, better in the range 0.7 to 1.4, better still in the range 0.8 to 1.3. As a result, for teeth of lengths that are relatively similar or equal, an envelope surface of the applicator member does not present any discontinuities that are too great.

In general, the term "region of the core" should be understood as covering a longitudinal portion of the core that extends angularly, continuously around the longitudinal axis, e.g. over about 180°, or over some other angular sector, e.g. lying in the range 150° to 210°. The first and second regions of the core may optionally be symmetrical to each other, with axial symmetry or symmetry about a plane. The first and second regions of the core may be defined by a plane that includes the longitudinal axis of the core, e.g. a midplane of the core, which may be a midplane of symmetry of the core. Optionally, the core may present opposite side surfaces that do not have teeth. Each side surface may extend between first rows and second rows. Each side surface may extend angularly over at least 60°, or 45°, or 30°, around the longitudinal axis of the core.

The applicator member may include an endpiece that is molded integrally with the core, and that is designed to be secured to a handle of the applicator, e.g. via a stem. For example, the endpiece is designed to be inserted in a complementary housing formed in the distal end of a stem, which stem has its proximal end connected to the handle. The endpiece may thus form a core extension that does not have any teeth.

The endpiece may extend over a length measured parallel to its longitudinal axis that lies in the range 5 mm to 50 mm, or in the range 7 mm to 40 mm. This endpiece may be relatively long compared with known endpieces, which may provide great flexibility to the applicator according to exemplary embodiments of the invention.

A greatest transverse dimension of the endpiece may be greater than the greatest transverse dimension of the core.

The endpiece may have a cross-section taken perpendicularly to the longitudinal axis of the core that is of a shape selected from the following list, which is not limiting: circular, oval, elliptical, oblong, polygonal, regular or otherwise, triangular, square, rectangular, pentagonal, hexagonal, and octagonal.

The endpiece may include one or more constricted portions serving to improve the flexibility of the applicator and thus its suppleness in application.

Free ends of the teeth of the applicator member may define an envelope surface of the applicator member. The envelope surface may have a greatest transverse dimension measured perpendicularly to the longitudinal axis of the core that is less than or equal to 11 mm, or less than or equal to 10 mm, better less than or equal to 9 mm, e.g. 7 mm±1 mm.

When observed perpendicularly to the longitudinal axis of the core, all or part of the envelope surface may be of a shape that is circular, oval, oblong, ellipsoidal, or polygonal.

The shape of the envelope surface may be due mainly to the arrangement of the teeth relative to the core, for example with the teeth being inclined to a greater or lesser extent relative to the longitudinal axis of the core or with the inclination of the teeth varying in non-monotonic manner on moving firstly towards the distal end of the core and secondly towards the proximal end of the core. In particular, the shape of the envelope surface need not be due solely to the fact that the teeth are of varying lengths.

The envelope surface may extend along a longitudinal axis that forms a non-zero angle with the longitudinal axis of the core.

The greatest transverse dimension of the envelope surface of the applicator element measured perpendicularly to the longitudinal axis of the core may lie in the range 9 mm to 14 mm, or be less than or equal to 6 mm, or less than 6 mm, or less than or equal to 5.95 mm, better less than or equal to 5.9 mm, or less that or equal to 5.7 mm, better still less than or equal to 5.5 mm, over at least 70% of the length of the applicator member, better over at least 80% of its length, or over 90% or even over its entire length.

The envelope surface may have a greatest transverse dimension, e.g. a diameter, that is substantially constant over at least a fraction of the length of the applicator member.

The envelope surface may also present a cross-section that varies over all or part of the length of the applicator member. By way of example it may have one or more extrema, for example at least one local minimum. The envelope surface may for example present a peanut-shape.

The teeth of the applicator member may include a longest tooth measured along its direction of elongation from the core that lies in the range 1.7 mm to 4.5 mm, better in the range 1.7 mm to 3.5 mm, or 2 mm to 3.5 mm. This tooth length may in particular be greater than a greatest transverse dimension of the teeth, measured perpendicularly to the direction of elongation thereof. More than half of the teeth may have a length as defined above, better at least 60%, or 70%, or better still 80% of the teeth.

It is possible for example to have an applicator presenting at least 10% of its teeth with a length greater than the greatest transverse dimension of the core, or at least 20%, at least 25%, at least 30%, at least 35%, at least 40%, at least 45%, at least 50%, at least 75%, or at least 90%.

The applicator may be made in such a manner that the teeth presenting a length as defined above are distributed all around the core over at least a fraction of the length thereof, thereby defining a combing surface having properties that are substantially uniform all around the core, for at least a fraction of the length of the applicator member.

The teeth having a length as defined above may for example be situated at least in the middle portion of the core, in particular between the first fourth and the last fourth of the visible length of the core or between the proximal end and the first fourth or between the last fourth and the distal end.

The teeth of the applicator member may all have the same length, possibly with the exception of those situated at the vicinity of each of the two axial ends of the core or between the proximal end and the first fourth or indeed between the last fourth and the distal end.

The applicator may have teeth with a length no greater than 1.8 mm, e.g. lying in the range 0.5 mm to 1.8 mm.

In some exemplary embodiments of the invention, the majority of the teeth of the applicator may be of length lying in the range 0.5 mm to 1.8 mm, or in the range 0.5 mm to 1.49 mm, e.g. in the range 0.5 mm to 0.99 mm. More than half the teeth of a region of the core may be of length as defined above, better at least 60%, or 70%, or better still 80% of the teeth. The teeth of length as defined above may be situated in the central portion of the applicator member, for example.

In exemplary embodiments of the invention, 0% to 10%, or 10% to 20%, 20% to 30%, 30% to 40%, 40% to 50%, 50% to 60%, 60% to 70%, 80% to 90%, or 90% to 100% of the teeth extending perpendicularly to the longitudinal axis of the core are of length, measured in the direction of elongation of the teeth from the core, lying in the range 1.7 mm to 4.5 mm, better in the range 1.7 mm to 3.5 mm, or indeed 2 mm to 3.5 mm.

In general, the length of the teeth extending perpendicularly to the longitudinal axis of the core may be constant or varying.

The teeth, or all of the teeth, may have a cross-section of shape selected from the following, non-limiting list: triangular, semi-circular, and semi-elliptical, e.g. generally D-shaped. Such a shape may make it easier to unmold the applicator member. Unmolding may be made easier in particular when the teeth have a cross-section with at least one straight edge.

At least one tooth may present a cross-section that is circular, with or without a flat, or non-circular, being flattened, star-shaped, e.g. in the form of a cross or with several branches, or U-, H-, T-, or V-shaped, a shape that is hollow, e.g. circular or square, a shape forming branches, e.g. snowflake-shape, a shape that is prismatic, e.g. on a triangular, square, or hexagonal base, an oblong shape, in particular a lens or hourglass shape, a shape that is polygonal, regular or otherwise, in particular square, rectangular, octagonal, parallelogram-shaped, lozenge-shaped, or oval. At least one tooth may present at least one portion in relief in order to improve adhesion of the composition on the tooth. The cross-section of the tooth may decrease without changing shape on going away from the core, e.g. over more than half the length of the tooth.

Some of the teeth of the applicator, or all of the teeth, may have thickness measured at their bases, i.e. at the points where the teeth are connected to the core, lying in the range 0.3 mm to 0.6 mm, or in the range 0.3 mm to 0.5 mm. The term "thickness of a tooth" is used to mean the greatest traverse dimension of the tooth in section perpendicular to its direction of elongation. The applicator may include teeth of thickness lying in the range 0.2 mm to 0.5 mm, and/or other teeth of thickness lying in the range 0.5 mm to 0.65 mm, or greater than 0.5 mm.

When the thickness of the teeth lies in the range 0.2 mm to 0.5 mm, the teeth are relatively fine and they may also be relatively supple when the material from which they are made is a flexible material, e.g. a thermostatic material, optionally an elastomer.

When the thickness of the teeth lies in the range 0.5 mm to 0.65 mm, the teeth are thicker and they may be more rigid.

By way of example, the thickness of the teeth may be selected as a function of the type of makeup that is desired and/or of the nature of the eyelashes and/or of the rheology of the composition.

At least one tooth may have a profile that is frustoconical, e.g. terminating in a rounded free end, such that the cross-section of the tooth decreases from its base towards its free end. In general, the teeth may in particular be cylindrical, frustoconical or pyramid-shaped.

By way of example, teeth of a certain thickness may be interleaved between teeth having some other thickness, or in a variant teeth having a certain thickness may be grouped together in a first region of the applicator member, while teeth having another thickness are grouped together in a second region of the applicator member, e.g. opposite from the first.

The teeth of the applicator member may thus be of thickness that is constant or otherwise.

The applicator may include a larger number of teeth, with the teeth being close together, so as to avoid filling the applicator with too much composition between the teeth, as would happen if they were placed too far apart. The applicator may have 75 to 500 teeth, for example.

The teeth may be placed in rows extending along the longitudinal axis of the core. The term "row" is used to designate a succession of teeth that are situated generally on the same side of the core and that follow one after another on going along the core.

The applicator may have a single row of teeth or two rows of teeth or even three rows of teeth extending along the longitudinal axis, e.g. one to 20 rows of teeth, better one to 18 rows, better still one to ten rows, e.g. six rows. With a row of teeth, the number of teeth may lie in the range six to 60, in particular in the range ten to 50. At least one row, and preferably each row, may include one or more teeth pointing towards the front and one or more teeth pointing towards the rear. At least one row may have only teeth that extend perpendicularly to the longitudinal axis of the cone.

At least one row of teeth may extend along an axis that is straight, which may optionally be parallel to the longitudinal axis of the core.

At least two teeth of at least one row may present lengths that are different or identical. A row of teeth extending along the longitudinal axis may have at least three teeth of the same length.

The applicator may have at least one or more rows of small teeth having a maximum length measured from the core of 1.75 mm, for example. Furthermore, the applicator may include at least one or more rows of large teeth of greater length measured from the core, e.g. lying in the range 1.35 mm to 3 mm. The minimum length of the large teeth may be at least 0.25 mm greater than the maximum length of the small teeth. A first region of the core may carry only such small teeth and a second region of the core may carry only such large teeth.

The rows of teeth may be located on the core in substantially constant manner around the core, at least over a fraction of the length of the applicator member.

In addition, a row of large teeth may be arranged on the core in a manner that is different from a row of small teeth, the two rows differing by one or more of the following characteristics: the spacing between the teeth in the row; the number of teeth in the row; and the thickness of the teeth measured perpendicularly to their direction of elongation.

The rows of teeth may be disposed in at least one group of close-together rows, the locations of the groups of close-together rows on the core being substantially constant around the core over at last a fraction of the length of the applicator member. The teeth of a group of close-together rows may be parallel to one another within a given group.

At least two teeth of at least one row may present shapes that are different or identical. At least two teeth of at least one row may be of different colors. At least one tooth of at least one row may present a shape that is generally tapering towards its free end. At least one tapering tooth may be cylindrical, frustoconical or pyramid-shaped.

When the applicator has a plurality of rows of teeth, at least one tooth of one of the rows may present a shape that is different from a tooth of another row. By way of example, at least one tooth of a row may present a length that is different from the length of another tooth of the same row, in particular a tooth that is consecutive within the row.

In exemplary embodiments of the invention, the applicator includes a molded applicator member comprising:

a core extending along a longitudinal axis having first and second opposite regions, each extending along the longitudinal axis;

first rows of teeth extending longitudinally from the first region;

second rows of teeth extending longitudinally from the second region; and at least half of the first rows of teeth of the two first consecutive rows, better at least two-thirds, better still all of the teeth differ, in terms of thickness, from at least half of the teeth of two consecutive second rows, better at least two-thirds, better all of the teeth.

The term "two consecutive rows" should be understood as two rows of teeth, e.g. two longitudinal rows of teeth, that follow one after the other on going around the longitudinal axis of the core, which axis may be rectilinear or curved.

In exemplary embodiments of the invention, the applicator includes a molded applicator member comprising:

a core extending along a longitudinal axis having first and second opposite regions, each extending along the longitudinal axis;

first rows of teeth extending longitudinally from the first region;

second rows of teeth extending longitudinally from the second region; and at least half of the first rows having a number of teeth per row that differs from the number of teeth per row in at least half of the second rows.

In these exemplary embodiments of the invention, all of the first rows carried by the first region may have the same number of teeth each, and all of the seconds row carried by the second region may likewise have the same number of teeth each, the number $n_1$ of teeth in the first rows differing from the number $n_2$ in the second row. For example $n_1/n_2 \geq 1.3$, or $n_1/n_2 \geq 1.5$, or $n_1/n_2 \geq 1.8$, or even 2.

Within each row supported by the first or the second region, the teeth may be substantially touching, with the spacing between two consecutive teeth being less than or equal to 0.1 mm, for example. The spacing corresponds to the smallest gap between the outside surfaces of two consecutive teeth at their bases.

Each row of teeth may comprise teeth in perfect alignment. In a variant, each row of teeth may comprise a succession of teeth disposed in a staggered configuration.

In exemplary embodiments of the invention, the applicator includes a molded applicator member comprising:

a core extending along a longitudinal axis having first and second opposite regions, each extending along the longitudinal axis;

first rows of teeth extending from the first region;

second rows of teeth extending from the second region; and the number $m_1$ of teeth carried by the first region being greater than the number $m_2$ of teeth carried by the second region, e.g. with $m_1/m_2$ greater than or equal to 1.3, or $m_1/m_2$ greater than or equal to 1.5, or $m_1/m_2$ greater than or equal to 1.75, or 2.

The first rows of teeth may have more teeth per row than the second rows, for example. The first rows of teeth may have teeth of thickness that is different from the thickness of the teeth of the second rows.

In other exemplary embodiments of the invention, the applicator for combing the eyelashes or the eyebrows and/or for applying a composition to the eyelashes and/or the eyebrows includes a molded applicator member comprising:

a core extending along a longitudinal axis having first and second opposite regions, each extending along the longitudinal axis;

first rows of teeth extending from the first region; and second rows of teeth extending from the second region;

at least half of the teeth carried by the first region having a thickness $e_1$ and a length $l_1$ and at least half of the teeth carried by the second region having a thickness $e_2$ and a length $l_2$, where $e_1 \neq e_2$ and $l_1 \neq l_2$.

In exemplary embodiments of the invention, the applicator includes a molded applicator member that does not have an axis of symmetry, the member comprising:

an inner core that is elongate along a longitudinal axis, having first and second opposite regions, each extending along the longitudinal axis; and a plurality of rows of teeth, the rows extending along the longitudinal axis of the applicator member, in which the first and second rows of teeth extend respectively from first and second regions of the core;

the teeth of the first rows differing from the teeth of the second rows by at least one of the following: their shape; color; length; thickness; material; hardness; spacing within the row; and/or orientation within the row; and teeth in each of the regions extending outwards in at least three different directions.

In general, for all of the applicator members, the core need not support rows of teeth other than the first and second rows.

In exemplary embodiments of the invention, the majority or even all of the teeth extending from the first region differ from the majority or even all of the teeth extending from the second region in at least one of the following: their shape; color; length; thickness; material; hardness; spacing within the row; and/or orientation in the row.

At least one row of teeth may be placed on the core in a manner that is different from the other row of teeth, the two rows differing in at least one of the following: the length of the teeth; the spacing between the teeth within the row; the locations of the teeth in the row; the number of teeth within the row; the thickness of the teeth measured perpendicularly to their direction of elongation; the material from which the teeth are made; the shape of the teeth; the shape of the cross-section of the teeth; and the color of the teeth.

The teeth of the first rows of teeth may be spaced apart at a first spacing, the teeth of the second rows of teeth may be spaced apart at a second spacing, the first spacing differing from the second spacing, in particular being smaller.

The teeth of the first rows of teeth may be of thickness that is less than the thickness of the teeth of the second rows of teeth. The widths of the teeth are measured at a given distance from the core, e.g. at zero distance from the core, i.e. at the bases of the teeth.

The teeth of the first rows of teeth may be of thickness that is smaller than the thicknesses of the teeth of the second rows, and they may be made of a material that is harder than the teeth of the second rows. Conversely, the teeth of the first rows may be of thickness that is smaller, and they may be made of a material that is more flexible than the teeth of the second rows.

The teeth of the first rows of teeth and the teeth of the second rows of teeth need not be arranged in the same manner within the row relative to the core.

When the core is observed along its longitudinal axis, two teeth of a row may extend at their bases in respective directions that form between them a first angle, and two teeth of another row may extend at their bases in directions that form between them a second angle, which first and second angles may be equal or different.

Within each row, the teeth may be spaced apart regularly along the longitudinal axis of the row or they may be bunched together in groups of two or more teeth, with the spacing between the teeth within a group along the longitudinal axis of the row being less than the spacing between two adjacent groups of teeth of said row, for example.

By varying the shape of the teeth and their spacing, it is possible to constitute gaps of greater or lesser size between the teeth, which gaps can be filled with composition.

Two rows of teeth may be made of respective different materials.

Two rows of teeth may have teeth of different colors.

The teeth of one row of teeth may be made of different materials, e.g. of different hardnesses or of different colors.

A first row of teeth may include teeth, e.g. at a given abscissa point along the core, that have a first length, and a second row of teeth may have teeth, e.g. at the same abscissa point, having a second length that is different from the first.

At least two successive teeth of a row may optionally be touching at their bases, with all of the teeth either being touching or non-touching at their bases, for example. The spacing between the teeth as measured at the bases of the teeth may lie in the range 0 mm to 1.2 mm within a row, e.g. in the range 0.01 mm to 1 mm. When the teeth touch at their bases, the spacing between the teeth measured at the bases of the teeth is zero.

Furthermore, the spacing between the teeth and the lengths of the teeth within a given row or in two different rows need not necessarily be constant.

When the applicator is observed from the side perpendicularly to its longitudinal axis, at least two teeth may define a V-shaped groove.

Teeth of one row and teeth of another row may extend in directions that are different.

The teeth of one row may have bases that are substantially in alignment, i.e. the centers of the bases of three consecutive teeth lie substantially on a common straight line.

The teeth of at least one row may join a corresponding longitudinal space of the core all on the same side of a longitudinal mid-line of said longitudinal face.

The teeth may have bases that are not centered on the longitudinal face of the core to which they are connected.

The bases of the teeth in a row may be in alignment or placed in a staggered configuration. When placed in a staggered configuration, a plurality of consecutive teeth of the row may be offset at least in part in alternation on either side of a geometrical separation surface. The consecutive teeth may be fully offset in alternation on either side of the geometrical separation surface. The term "fully offset" should be understood as meaning that the geometrical separation surface does not intersect the teeth, coming no closer than being tangential thereto.

All of the teeth of each row may be offset in alternation on either side of a geometrical separation surface associated with the row. In a variant, teeth may be offset on either side of the geometrical separation surface, not in alternation, but in groups of teeth, e.g. in groups of two or three teeth.

Two consecutive teeth of a row need not be images of each other differing merely by a shift in translation, in particular when the teeth present cross-sections that are not circular in shape.

At least two consecutive teeth of a row of teeth may have first faces having a first shape in common, e.g. a plane shape, in particular at least at a bottom portion of each tooth, and second faces having a second shape in common, e.g. a non-plane shape, in particular a rounded shape. The first faces may be oriented in the same direction of turning about the core, i.e. they may all be directed in the same clockwise or counter-clockwise direction when the core is observed along its longitudinal axis.

The first faces of the teeth, in particular when they are plane, may join the corresponding face of the core substantially perpendicularly, at least for some of the teeth in the row. At least one tooth, or even each tooth, may present a plane face that is parallel to its direction of elongation.

The teeth may optionally be rectilinear, e.g. each tooth extending along a long axis for the tooth that is rectilinear, or even curved, e.g. undulating. The terms "long axis of the tooth" or "elongation axis of the tooth" are used to mean an axis that passes through the centers of gravity of the cross-sections of the tooth.

Each row of teeth may extend on the core along a longitudinal axis of the row. The longitudinal axis of the row is an axis to which the bases of the teeth of the row, i.e. the straight line passing through the center of the bases of the teeth if the teeth are accurately in alignment, or the axis passing through the geometrical separation surface if the teeth are in a staggered configuration.

The longitudinal axis of a row is considered as being at the surface of the core, so two longitudinal axes of two successive rows on going around the longitudinal axis of the core may be angularly spaced apart by an angle of less than 80°, e.g. an angle of about 60°, or less than 50°, e.g. about 45°, or even less. The distribution of the longitudinal axes of the rows at the surface of the core may be substantially regular, with substantially constant spacing between them, equal to a predefined value ±20%, better ±10%, better still ±5%.

In a particular embodiment, the applicator member includes at least one row in which at least half, or even three-fourths, or even all of the teeth extend perpendicularly to the longitudinal axis of the core, and also at least one row, other than the preceding row, that includes at least one tooth extending towards the front and at least one tooth extending towards the rear, or even a set of teeth forming an optionally asymmetrical fan, a half-fan, or indeed a multiple-fan configuration. Preferably, these two rows are consecutive. It is also possible, in the row in which at least half or even three-quarters or even all of the teeth extend perpendicularly to the longitudinal axis of the core, for the spacing of the teeth in the row, the number of teeth in the row, and the thickness of the teeth to be different or constant.

The arrangement and the distribution of the teeth on the core may be relatively regular.

On going around the longitudinal axis of the core, it is possible for example to encounter a tooth about once every 360°/n where n lies in the range 2 to 20, better 4 to 16, better still 6 to 10.

A relatively regular distribution of teeth around the longitudinal axis of the core may make the applicator easier to use without its angular position being identified.

The applicator member may avoid having any tooth-free portion that extends angularly over more than one-eighth of a turn, thus making it easier to use given that the user does not need to orient the applicator too precisely relative to the eye.

For example, the teeth may extend in at least six different directions around the longitudinal axis of the core.

In exemplary embodiments of the invention, the teeth are made by being molded together with the core or by being molded onto the core.

In a variant, the core may include a sleeve carrying the teeth, which sleeve is mounted to be at least partially free to turn about a kernel of the core, the kernel being for mounting to the stem, as explained in application EP 1 935 279, the content of which is incorporated herein by reference.

In exemplary embodiments of the invention, the eyelashes may pick up composition on contact with the core. The core may thus contribute actively in applying the composition to the eyelashes, thereby providing greater freedom in how the teeth are chosen and arranged.

At least one tooth of a row may extend, at least in its portion that is connected to the core, and possibly over its entire length, in a first direction $Z_1$ that is perpendicular to the longitudinal face of the core to which the tooth is connected, or that makes a small angle with the normal to said surface of the core, e.g. less than 10°, better less than 5°. A consecutive tooth in the row may extend from the same face of the core in a second direction $Z_2$, at least in the portion thereof that is connected to the core, or indeed over its entire length, making an angle $\alpha$ with the first direction when the core is observed along its longitudinal axis.

The teeth may be considered as belonging to the same row, even if they lie on opposite sides of a mid-line, providing they are located along a longitudinal axis of the row that is parallel to the longitudinal axis of the core that carries this row, or parallel to the longitudinal face of the core from which the teeth extend, when said face can be defined relative to the remainder of the row, e.g. as lying between longitudinal edges of the core.

Substantially half of the teeth of a row may extend parallel to the first direction Z. The angle $\alpha$ between the directions $Z_1$ and $Z_2$ may lie in the range 5° to 80°.

The applicator member need not have any teeth that are oriented in opposite gyratory directions. For example, when the core is observed from its distal end, all of the teeth extending obliquely may be oriented in the counterclockwise direction.

The core may include at least one longitudinal face that is plane. In a variant, the core may include at least one longitudinal face that is not plane, e.g. being concave or convex, at least in part.

The core may present a profile that varies, in particular when observed perpendicularly to its longitudinal axis. Specifically, the core may present a transverse dimension that reaches a minimum in a central portion of the core, along its longitudinal axis.

The core may present a longitudinal face that is concave or convex in cross-section, with the concavity or the convexity possibly varying on going along the longitudinal axis of the core.

The core may present at least one face from which teeth extend that present varying width on going along the longitudinal axis of the core.

The core may present a cross-section that is substantially constant, at least over a fraction of its length. The core may also present a cross-section that varies. The cross-section of the core may pass through an extremum, e.g. substantially halfway along the core, said extremum being a minimum, for example. This may give additional flexibility to the core, thereby enabling an envelope surface to be defined that is of section that varies along the applicator member, in particular when the length of the teeth is constant within a row, at least over a portion of the applicator member.

At a first location along the longitudinal axis of the applicator member, the envelope surface of the applicator member may present a first cross-section that is substantially polygonal, and at a second location along a longitudinal axis, it may present a second cross-section that is substantially polygonal, with at least one vertex of the first cross-section being connected to at least a second vertex and a third vertex of the second cross-section via respective edges, the first and second vertices being offset angularly around the longitudinal axis of the applicator member, at least one of the first and second cross-sections being centered on the longitudinal axis of the applicator member.

The core may present a longitudinal face that is twisted. The applicator member may present a helical distribution of teeth on the core, pointing towards the right or to the left on going towards the distal end of the applicator member.

The applicator may have a single row of teeth per longitudinal face of the core.

The length of a row may lie in the range 10 mm to 45 mm approximately, in particular in the range 15 mm to 35 mm, or even 20 mm to 30 mm, e.g. being about 25 mm.

When the core is observed along its longitudinal axis, the shift from one row to the others may be undertaken by turning the core through an integer submultiple of 360° about the longitudinal axis of the core, e.g. by turning it through 360°/n, where n is an integer number lying in the range 3 to 20, for example.

In a cross-section plane, the core may present axial symmetry, in particular about its longitudinal axis.

At least one point along its length, the core may extend along a longitudinal axis that makes an angle with the longitudinal axis of the stem to which the core is fastened. The applicator member may be bent where it is connected to the stem.

The core may include a recess in which a support portion is engaged, e.g. a portion made of metal or of plastics material. The core may be configured to be fastened to said support or to be free to move in rotation or in translation relative to the support.

In a variant, the core portion supporting the teeth may be solid. The core may have a housing at only one of its ends so as to enable it to be fastened to a stem that is connected to a handle.

The core and its teeth may be molded out of the same material, or in a variant they may be made out of at least two different materials. A portion of the core and of the teeth may be made of a first material, for example, while another portion of the core and of the teeth may be made out of a second material.

Preferably the core is made of plastics material and comprises one or more thermoplastics materials.

The teeth may be made integrally with the core, e.g. by molding, in particular by injection molding. The teeth may be formed by injecting a single material, or they may be made by injecting a material onto the core, preferably a thermoplastic material, which material may be an elastomer. Where appropriate, injection may take place through the core.

The applicator member may be made by simultaneous dual injection of two materials into a single mold.

The applicator member is preferably entirely molded, i.e. in particular its core does not include any metal part.

The teeth may be made of a material that is more or less rigid than a material used for making the stem of the applicator to which the core is connected.

At least one of the core and a tooth may present magnetic properties. By way of example, these magnetic properties may be due to a filler of magnetic particles, e.g. ferrites, dispersed within the plastics material of the core and/or of the tooth.

At least one of the core and a tooth may be flocked, may receive any hot or mechanical treatment, and/or include particles, e.g. a filler, in particular to improve sliding.

The applicator may include a stem with the applicator member fastened to one end thereof. The core may be constituted by a part that is fitted to the stem of the applicator. The core may be fastened to the stem of the applicator by inserting an endpiece that extends the visible portion of the core into a housing formed in the end of the stem. In a variant, the core may have a housing that extends longitudinally into which the stem is inserted. In yet another variant, the core may be made integrally with the applicator stem by molding a plastics material.

The core may be of one or more plastics materials that are more or less supple than the material used for making the applicator stem.

The diameter of the stem may lie in the range 1.5 mm to 3.5 mm, for example.

At a second end, opposite from the first, the stem may be connected to a handle, which handle may be configured to close in leaktight manner a container that contains the composition for application. The container may include a wiper member that may be adapted to wipe the stem and the applicator member.

The applicator may be free from any metal, thereby making it suitable for placing in a microwave oven.

When observed perpendicularly to the longitudinal axis of the core, the envelope surface of the applicator may be of a shape that is circular, cylindrical, oval, oblong, ellipsoidal, or polygonal.

Where appropriate, the core may be hollow internally, and for example it may include a channel for delivering composition through the applicator member.

The invention also provides a packaging and applicator device for a composition for application to keratinous fibers, in particular the eyelashes or the eyebrows, the device comprising an applicator as defined above together with a container containing the composition. The handle of the applicator may constitute a closure cap for the container. The container may include a wiper member. The composition may be a mascara, e.g. a water-resistant mascara.

The invention also provides a method of making up the eyelashes or the eyebrows by means of an applicator as defined above.

BRIEF DESCRIPTION OF THE DRAWINGS

The invention can be better understood on reading the following detailed description of non-limiting embodiments thereof, and on examining the accompanying drawings, in which.

DETAILED DESCRIPTION

Figure 1:
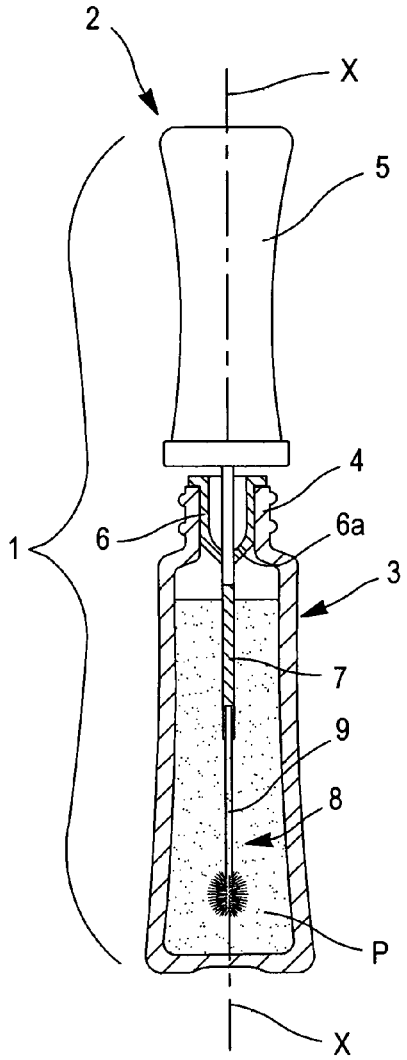
FIG. 1 is a diagrammatic elevation view, partially in longitudinal section, of an example of a device made in accordance with the invention.
Figure 1A:
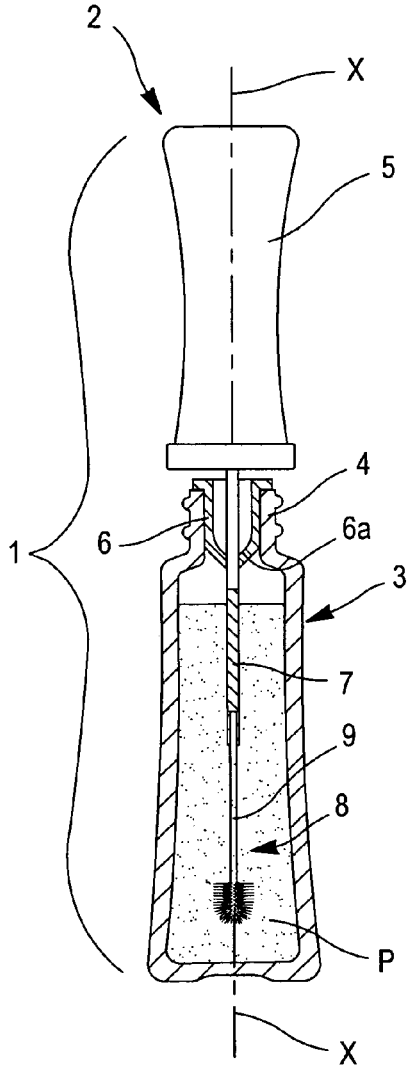
FIGS. 1*a* and 2*a* are diagrammatic views respectively analogous to FIGS. 1 and 2 showing a variant embodiment.
Figure 1B:
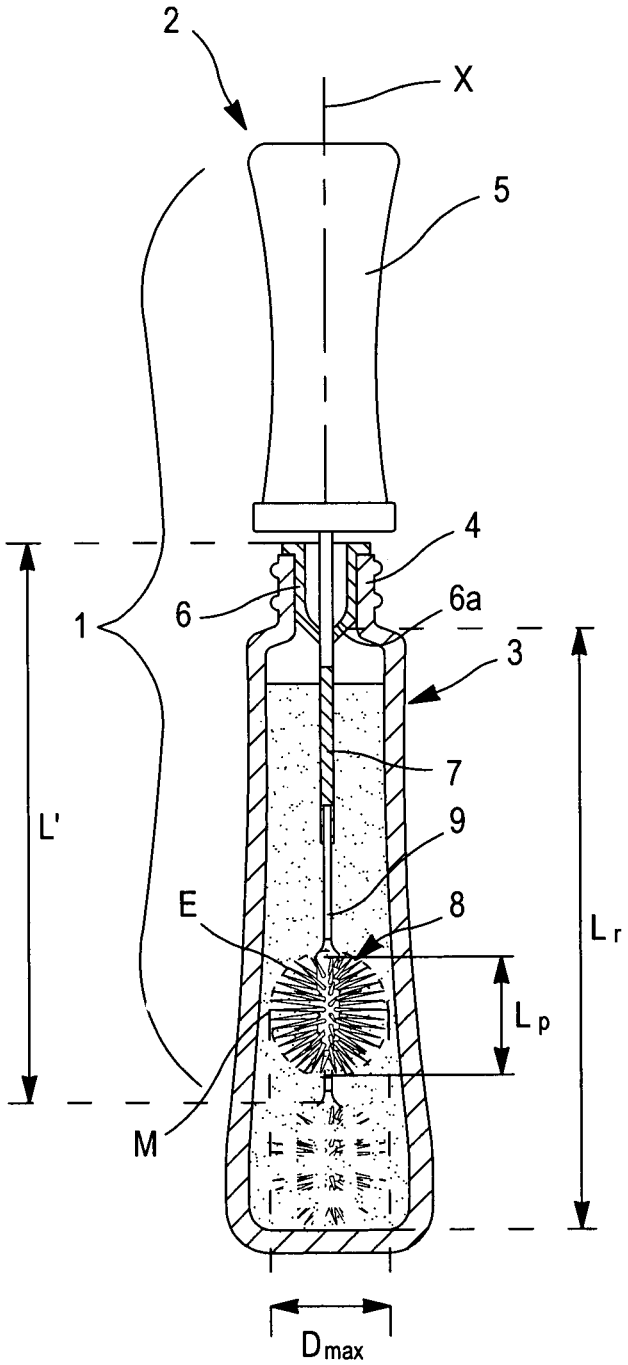
FIG. 1*b* is a diagrammatic view analogous to FIG. 1 showing a variant embodiment.

FIGS. 1, 1*a* and 1*b* show a packaging and applicator device 1 made in accordance with the invention, and comprising an applicator 2 and an associated container 3 containing a composition P for application to the eyelashes and/or the eyebrows, e.g. mascara or a care product.

In the example under consideration, the container 3 has a threaded neck 4 and the applicator 2 includes a closure cap 5 that is arranged to fasten on the neck 4 in order to close the container 3 in leaktight manner when not in use, the closure cap 5 also constituting a handle for the applicator 2.

The applicator 2 has a stem 7 of longitudinal axis Y that is connected at its top end to the closure cap 5 and at its bottom end to an applicator member 8. The applicator member comprises a core 10 carrying teeth 18.

The container 3 also includes a wiper member 6, e.g. inserted in the neck 4.

The wiper member 6 may be of any kind, and in the example described it comprises a lip 6*a* arranged to wipe the stem 7 and the applicator member 8 when the applicator 2 is withdrawn from the container 3. The lip 6*a* defines a wiping orifice of diameter that matches that of the stem.

In the example shown, the stem 7 presents a cross-section that is circular, however it would not go beyond the ambit of the present invention for the stem 7 to present some other section, in which case the cap 5 could be fastened to the container 3 in some manner other than screw-fastening, should that be necessary. The wiper member 6 may be adapted to the shape of the stem 7 and to the shape of the applicator element 8, where appropriate.

In the example under consideration, the longitudinal axis Y of the stem 7 is rectilinear and coincides with the longitudinal axis of the container 3 when the applicator 2 is in place thereon, however it would not go beyond the ambit of the present invention for the stem 7 to be non-rectilinear, e.g. forming a bend.

Where appropriate, the stem 7 may include an annular constriction in its portion that takes up position in register with the lip 6*a* of the wiper member 6 so as to avoid stressing it mechanically excessively during storage.

The applicator member 8 includes an endpiece 9 enabling it to be fastened in the stem 7. In the embodiment shown in FIG. 1, this endpiece 9 is a body of revolution, being circular in cross-section.

In particular, FIG. 1*b* shows an applicator member 8 with teeth extending along the length of the core thereof $L_p$ and defining an envelope surface E of varying cross-section that passes through a maximum M, a container 3 defining an inside space containing the composition P that is of height $L_r$ that is twice the length $L_p$.

In addition, in FIG. 1*b*, the maximum cross-section of the envelope surface E of the applicator member with a maximum transverse dimension $D_{max}$, occupies more than 70% of the inside section of the container 3 along the path traveled by the applicator member 8 on being extracted from the container 3. The height of this path is more than twice the length of the core from which the teeth $L_p$ extend. Dashed lines show the position of the applicator member 8 when the container 3 is closed.

Figure 2:
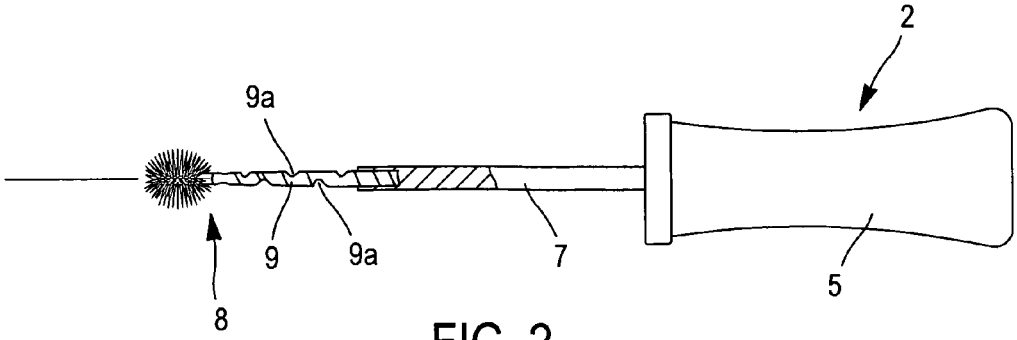
FIG. 2, partially in longitudinal section, shows in isolation a variant embodiment of an applicator in accordance with the invention.
Figure 2A:
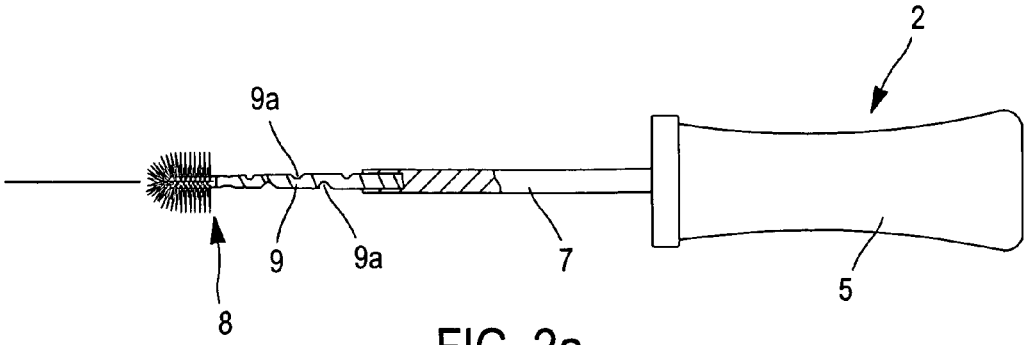

It would not go beyond the ambit of the present invention if, as shown in FIGS. 2 and 2*a*, the endpiece were to include constrictions 9*a* serving to improve the flexibility of the applicator and to make application more supple.

In particular, the applicator member 8 may be fastened by assembly as a force-fit, by snap-fastening, by adhesive, by heat-sealing, or by crimping, in a corresponding housing provided at the end of the stem 7. In a variant, the stem may be inserted in a housing provided in the core.

The core 10 may also be molded integrally with the stem 7.

Figure 48:
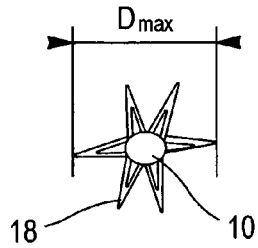
FIG. 48 is a diagrammatic cross-section of an embodiment.
Figure 5E:
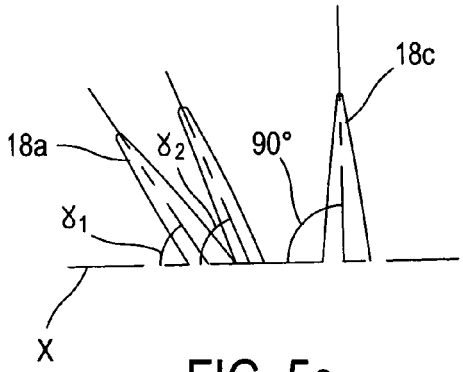
FIG. 5*e* is a diagrammatic and fragmentary longitudinal section of the FIG. 3*a* applicator member.

The greatest transverse dimension $D_{max}$ of the applicator member, as shown in FIG. 48, lies for example in the range 9 mm to 14 mm, and may be less than or equal to 6 mm.

With reference to FIGS. 3 to 5 and 3*a*, it can be seen that the core 10 may be of elongate shape extending along a longitudinal axis X with a greatest transverse dimension A as measured perpendicularly to its longitudinal axis that lies in the range 1.5 mm to 3.5 mm, for example.

In the example under consideration, the core 10 presents a cross-section over the major fraction of its length that is polygonal, with sides that define longitudinal faces 15 that are substantially plane. By way of example, the longitudinal axis X is central, as shown.

Each of the longitudinal faces 15 in the example shown is connected to a single row 17 of teeth 18.

In the example under consideration, the teeth 18 are molded integrally with the core 10 out of thermoplastic material.

For molding the applicator member 8, it is possible to use a thermoplastic material that is optionally relatively rigid, e.g. styrene-ethylene-butadiene-styrene (SEBS), a silicone, latex, butyl rubber, ethylene-propylene-terpolymer rubber (EDPM), a nitrile rubber, a thermoplastic elastomer, a polyester elastomer, polyamide, polyethylene, or vinyl elastomer, a polyolefin such as polyethylene (PE) or polypropylene (PP), polyvinyl chloride (PVC), ethylene vinyl acetate copolymer (EVA), polystyrene (PS), polyethylene terephthalate (PET), polyacetal (POM), polyamide (PA), or polymethyl methacrylate (PMMA). In particular, it is possible to use the materials known under the trademarks Hytrel®, Cariflex®, Alixine®, Santoprene®, Pebax®, this list not being limiting.

The teeth and the core may be made of different materials.

Figure 5B:
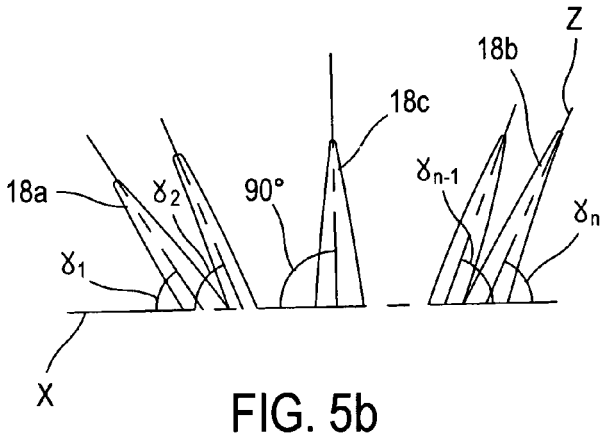
FIG. 5*b* is a diagrammatic and fragmentary longitudinal section of the applicator member of FIGS. 3 to 5.
Figure 3:
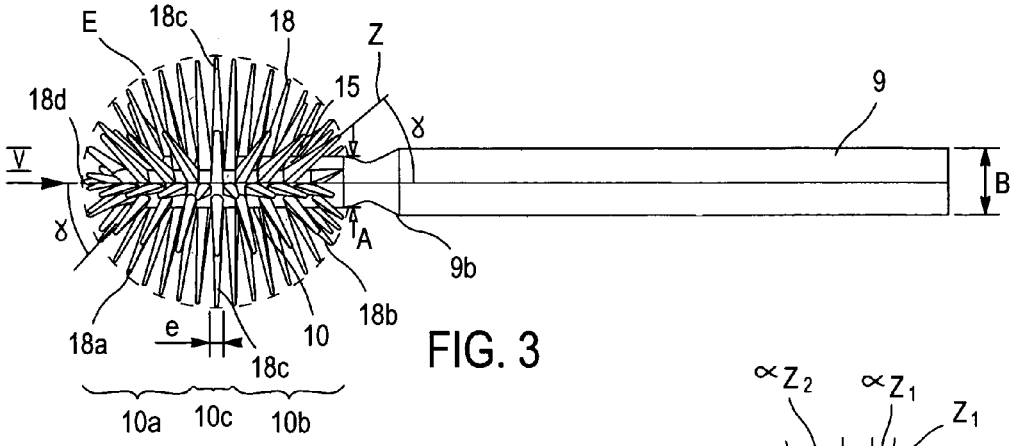
FIG. 3 is a side view showing, in isolation, the applicator member of FIG. 1.
Figure 5A:
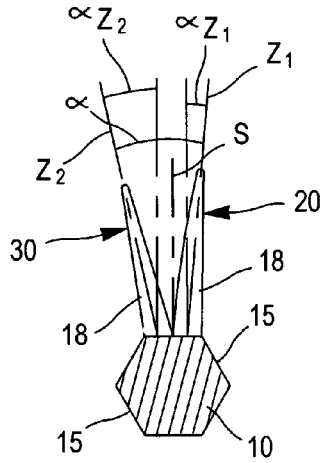
FIG. 5*a* is a diagrammatic and fragmentary cross-section of the applicator member of FIGS. 3 to 5 and 3*a;*
Figure 4:
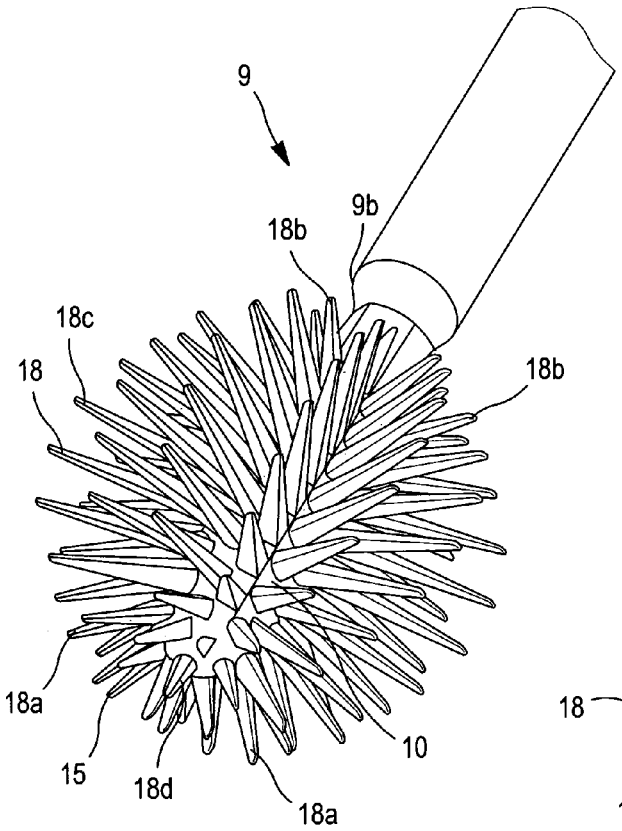
FIG. 4 is a fragmentary perspective view of the applicator member of FIG. 3.
Figure 5:
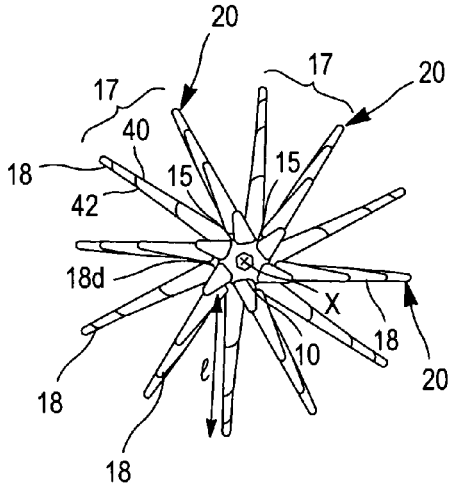
FIG. 5 is a face view looking along arrow V of FIGS. 3 and 3*a;*

In FIGS. 3, 4 and 5, the teeth 18 include teeth 18*a* that extend towards the front of the applicator member and teeth 18*b* that extend towards the rear of the applicator member, when the member is observed along the longitudinal axis X of the core. "Towards the front" corresponds to getting closer to a plane perpendicular to the longitudinal axis of the core and containing the distal end of the applicator.

In the example described, the teeth 18*a* are to be found on a portion 10*a* of the core containing the distal end 12 of the core 10, and the teeth 18*b* are to be found on a portion 10*b* of the core that is connected to the endpiece 9.

The applicator member 8 also includes teeth 18*c* extending perpendicularly to the longitudinal axis of the core, and situated in the example described on a middle portion 10*c* of the core, situated between the portions 10*a* and 10*b*.

The teeth 18*a* and 18*b* that are inclined relative to the longitudinal axis X of the core extend in a direction of elongation making an angle γ with the longitudinal axis X, said angle γ having different values for several teeth. On going along the longitudinal axis X of the core, the angle γ increases and then decreases as shown in FIG. 5*b*. On going along the core from its distal end 12, the angle γ passes from a value of 0° for the end tooth 18*d* having its direction of elongation coinciding with the longitudinal axis X, to a value of 90° for the teeth 18*c*, and then the angle γ decreases on coming closer to the endpiece 9. The angle γ takes values $\gamma_1, \gamma_2, \ldots, \gamma_{n-1}$, and $\gamma_n$ as the observer moves along the longitudinal axis of the core.

In the example described, the applicator member 8 has a single tooth 18*c* per row 17 that extends perpendicularly to the core, with all the other teeth extending at an angle γ not equal to 90° relative to the longitudinal axis X of the core.

Naturally, it would not go beyond the ambit of the present invention if the arrangement were different, with each row having some larger number of teeth 18*c* extending perpendicularly to the longitudinal axis X of the core.

Figure 3A:
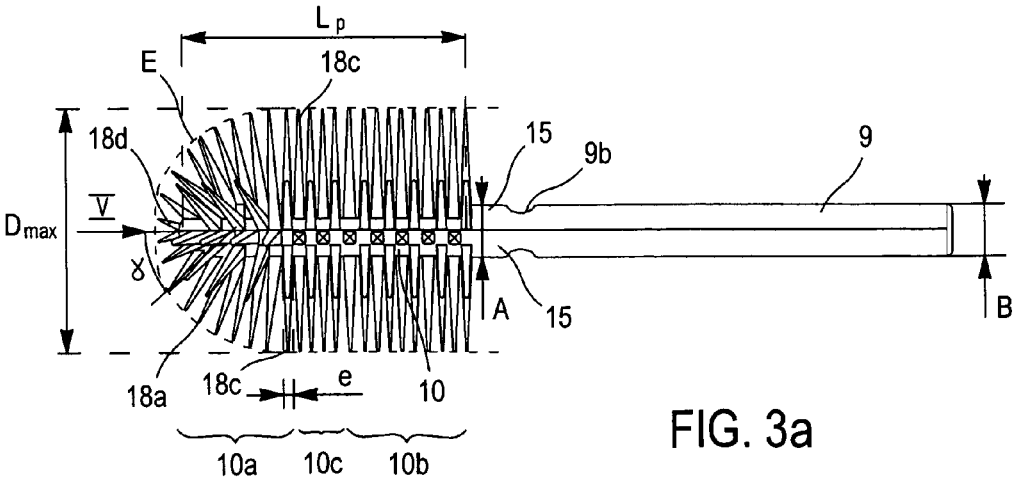
FIG. 3*a* is a diagrammatic view analogous to FIG. 3 showing an embodiment.

As shown in non-limiting manner in FIG. 3*a*, it is possible for the applicator member to have only teeth extending perpendicularly to the longitudinal axis of the core 18*c* and teeth extending towards the front 18*a* occupying a length of the core $L_p$ that is greater than the greatest transverse dimension $D_{max}$ of the applicator member.

FIG. 3*a* shows a half-fan configuration towards the front on the side of the distal end and teeth perpendicular to the longitudinal axis of the core on the side of the proximal end.

In this example it is possible to have teeth that are perpendicular to the longitudinal axis of the core 18*c* in the fraction 10*b*.

Furthermore, in the example of FIGS. 3 to 5, some of the teeth 18*a* sloping towards the front of the applicator do not form part of one of the rows 17 extending from the longitudinal faces 15 of the core, but extend from the distal end 12 of the core 10, which end presents a rounded shape. Such a shape for the distal end 12 makes it easier to insert the applicator 2 into the container 3.

Figure 3B:
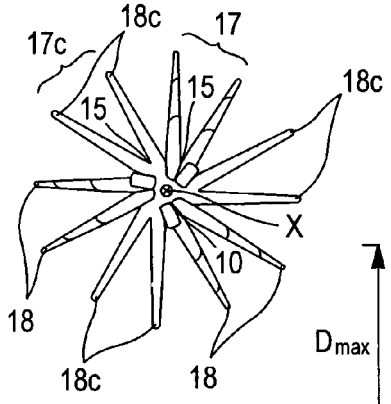
FIG. 3*b* corresponds to a variant embodiment of the invention.

FIG. 3*b* shows successive rows of teeth comprising rows 17*c* that are constituted in full by teeth that are perpendicular to the longitudinal axis of the core 18*c* and rows 17 that include at least one tooth 18*a* that extends towards the front and/or at least one tooth 18*b* that extends towards the rear.

The height of the teeth 18*a* may decrease on nearing the distal end 12 of the core 10, as can be seen in FIGS. 3, 3*a*, and 4.

The height of the teeth 18*b* may likewise decrease on nearing the endpiece 9, as shown in FIGS. 3 and 4, so as to make it easier for the applicator member 8 to go past the wiper member 6 when the applicator 2 is withdrawn from the container.

The distal end portion 12 of the core 10 may form a body of revolution, as can be seen in FIG. 4.

As shown, the applicator member 8 may include an annular constriction 9*b* formed between the core 10 and the endpiece 9, which constriction forms a body of revolution in the example described and serves to impart flexibility to the applicator member 8.

A greatest transverse dimension B of the endpiece 9 may be greater than a greatest transverse dimension A of the core 10, as shown in FIGS. 3 and 3*a*.

In the example described, there are six longitudinal faces 15, as can be seen in FIG. 5*a*, with the cross-section of the core being substantially hexagonal. In the example shown these faces 15 are plane.

Each row 17 of teeth 18 includes a first set 20 of first teeth that are connected thereto at an angle $\alpha_{Z1}$ relative to the normal to the corresponding face 15 of the core 10, and a second set 30 of teeth that are connected obliquely to said face 15 forming an angle $\alpha_{Z2}$ relative to the normal.

The teeth 18 in the first set 20 of teeth are straight, extending in a direction $Z_1$ that is substantially perpendicular to the face 15, the angle $\alpha_{Z1}$ being relatively small, e.g. less than 10°, or even less than 5°.

The teeth 18 of the second set 30 of teeth are likewise straight in the example under consideration, extending in a direction $Z_2$ forming an angle $\alpha$ with the direction Z. By way of example, the angle $\alpha$ lies in the range 20° to 80°.

In FIG. 5, it can be seen that each row includes teeth having a face that connects perpendicularly to the corresponding longitudinal face 15.

In the example described, the teeth 18 of each row 17 are located in a staggered configuration. Two consecutive teeth 18 of each row 17 are offset in alternation to one side and the other of a geometrical separation surface S, this surface S being a plane bisecting the angle $\alpha$, for example.

The teeth of the first set 20 are located on one side of this geometrical separation surface S, while the teeth of the second set 30 are located on the other side thereof, when the core 10 is observed along its longitudinal axis.

Within each row 17, the bases of the teeth of the first set 20 and of the teeth of the second set 30 are not in alignment since they are situated respectively on one side or the other of the geometrical separation surface S.

The teeth of the first set 20 and of the second set 30 do not overlap in the example shown when the applicator member is observed from the side, in a direction perpendicular to the axis X, as shown in FIG. 3.

Furthermore, the directions $Z_1$ and $Z_2$ of the teeth 18 of the first and second sets 20 and 30 of teeth do not intersect the longitudinal axis X of the core, the teeth being off-centered a little relative to said axis.

In FIGS. 3 to 5, and 3*a*, it can be seen in the example shown that each tooth 18 of the first set 20 of a row 17 may be associated with a respective tooth of the first set 20 of another row 17 that occupies substantially the same axial position along the axis X of the core, with the transition from one tooth to the other being performed by turning about the axis X through a submultiple of 360°, specifically through 90°. The same applies to each tooth 18 of the second set 30.

The oblique teeth 18 of the various rows are oriented in the same gyratory direction around the core, i.e. clockwise in FIGS. 3 and 3*a*.

By way of example, the teeth are of a length greater than 1.7 mm, at least for more than half of them. By way of example they have greatest thickness e lying in the range 0.2 mm to 0.65 mm.

In a variant, a majority of the teeth may have a length lying in the range 0.25 mm to 1.28 mm.

The applicator member 8 may have a greatest transverse dimension measured perpendicularly to the longitudinal axis X of the core that is less than or equal to 6 mm, preferably over at least 70% of its length.

Figure 5D:
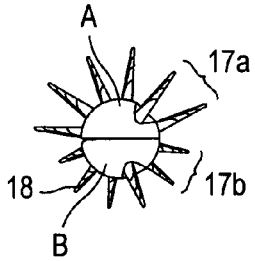
FIGS. 5*c* and 5*d* are views analogous to FIG. 5 showing variant embodiments.
Figure 5C:
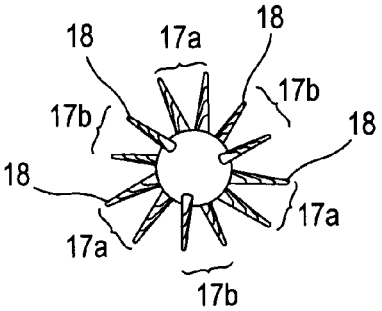
Figure 8:
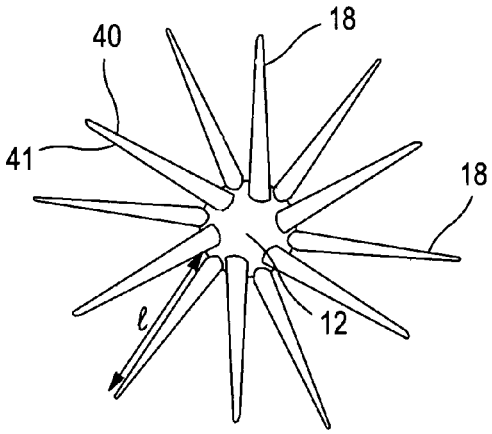
Figure 10:
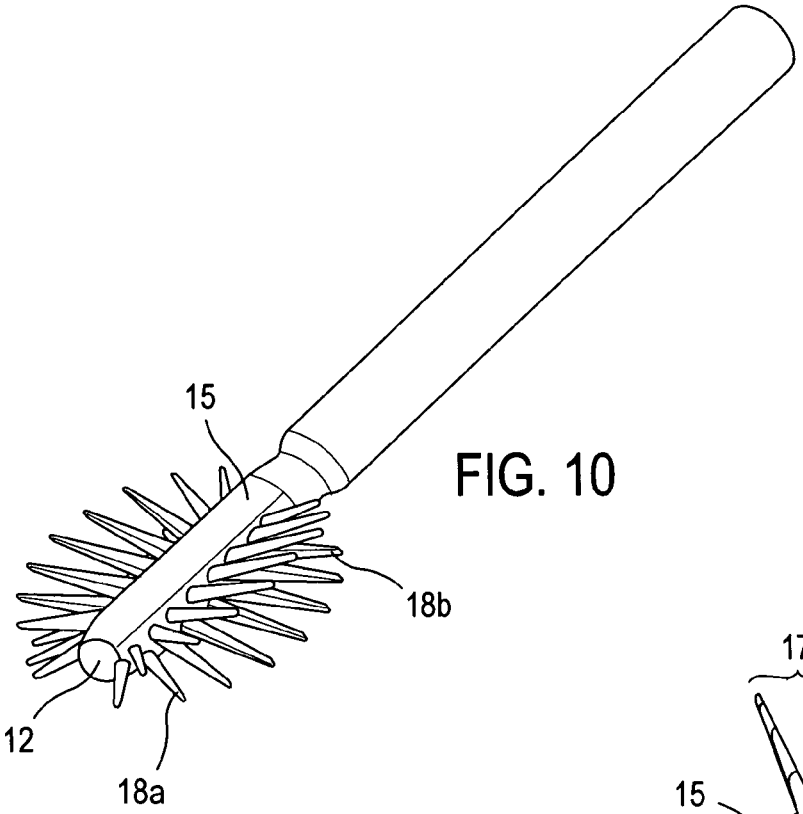
Figure 11:
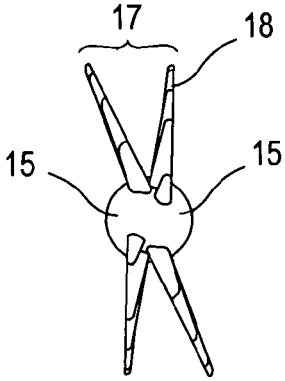

Independently or in combination with any of the characteristics described above, the applicator member may include at least three rows of teeth connected to the core, the rows extending along the longitudinal axis of the core, with at least one of the rows having large teeth and at least one of the rows having small teeth, as shown in FIG. 5*c*.

In this embodiment example, the rows 17*a* of large teeth alternate with rows 17*b* of small teeth, a single row 17*a* of large teeth following a single row 17*b* of small teeth.

Naturally, it would not go beyond the ambit of the present invention for a plurality of rows of large teeth to alternate with one or more rows of small teeth, or vice versa.

In another variant, the teeth 18 of the alternating rows 17*a* and 17*b* may differ by at least one of the following: their shape, height, or length, their material, their hardness, their spacing along the row, and/or their orientation in the row.

In addition, and where appropriate, rows of teeth may be disposed in at least one group of close-together rows, with the rows of teeth and/or the groups of close-together rows being implanted on the core in substantially constant manner around the core, at least over a fraction of the length of the applicator member, and when the applicator member includes at least one group of close-together rows, the teeth of the group of close-together rows are parallel to one another within the group.

In another variant, the applicator member 8 may include first and second opposite regions A, B, each extending along the longitudinal axis, the first rows of teeth extending from the first region A and the second rows of teeth extending from the second region B, the first rows of teeth of the first region differing from the second rows of teeth of the second region.

By way of example the first and second rows of teeth may differ in the lengths of the teeth, as shown in FIG. 5*d*, the first region A having long teeth and the second region B having short teeth, or they may differ in some other characteristic, e.g. selected from the following list: the number of teeth carried by the first region, where the number of teeth carried by the first region may be greater than the number of teeth carried by the second region, for example, or the first rows of teeth may have more teeth per rows than the second rows, for example; the thicknesses of the teeth, where the first rows of teeth may have teeth of thickness different from the thickness of the teeth in the second rows; shape; material; hardness; spacing within the row; and/or orientation within the row.

The embodiment shown in FIGS. 6 to 8 and 6*a* differs from that of FIGS. 1 to 5 and 3*a* specifically by the absence of any teeth 18*d* at the end 12 of the core 10.

Each of the longitudinal faces 15 of the core 10 may have a row 17 of teeth as described above, but it would not go beyond the ambit of the present invention if at least one face 15 has no row 17 of teeth, or indeed has no teeth 18 at all.

In the example shown in FIGS. 9 to 11, and 9*a* to 9*h*, and 9*j* to 9*l* only two faces 15 of the core 10, and more precisely two opposite faces 15, are provided with respective rows 17 of teeth 18 as described above, while the other four faces 15 have no teeth at all.

Figure 9A:
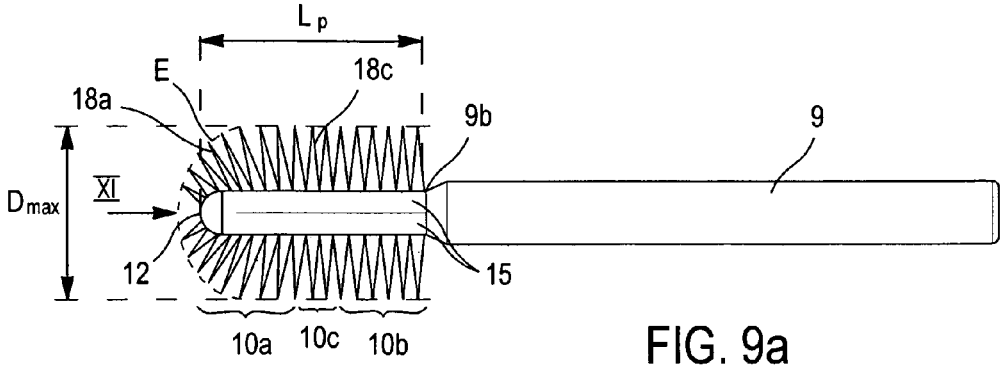
FIGS. 6*a*, 9*a* to 9*h*, 9*k* to 9*l*, 9*n* and 12*a* are diagrammatic views respectively analogous to FIGS. 6, 9, and 12, showing variant embodiments.

In particular, FIG. 9*a* shows a half-fan configuration towards the front including teeth 18*a* that are perpendicular to the longitudinal axis on the side of the proximal end and teeth 18*a* extending towards the front on the side of the distal end. In this configuration, the length occupied by the teeth $L_p$ is greater than $D_{max}$.

Figure 9B:
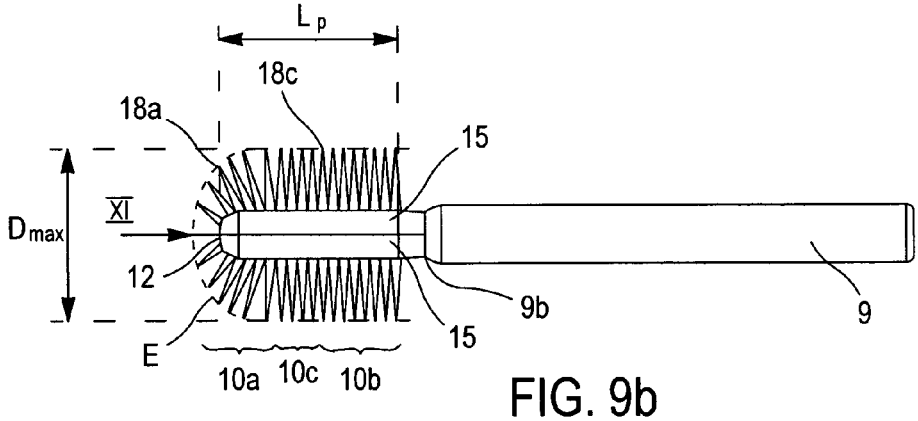

FIG. 9*b* is a diagram showing an embodiment that differs from that of FIG. 9*a* by the values for the pair ($L_p$, $D_{max}$).

Figure 9C:
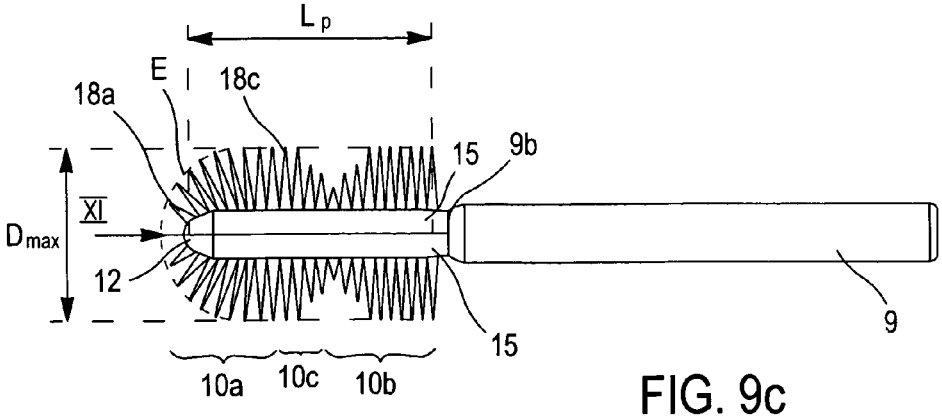
Figure 6:
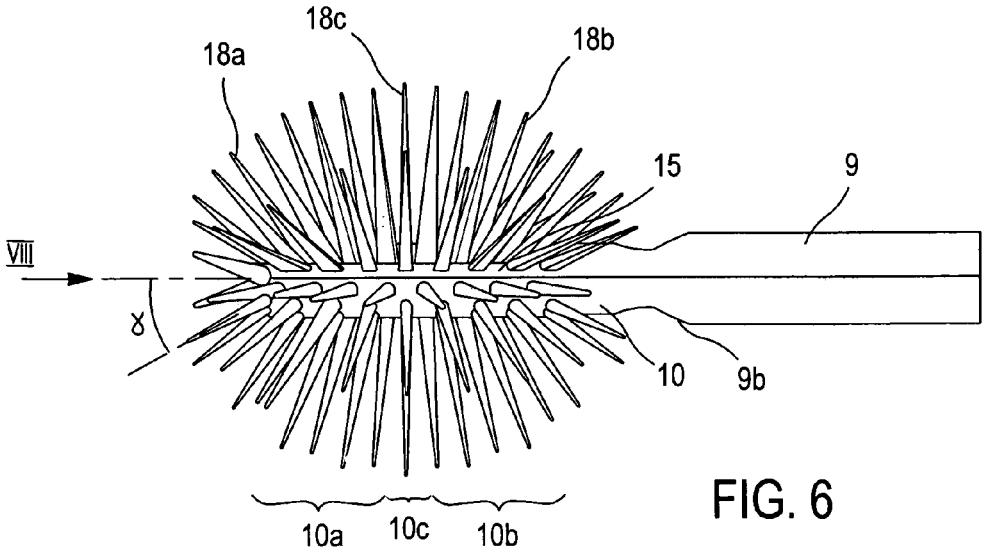
FIGS. 6 to 8, 9 to 11, and 12 to 14 are views of embodiment variants and analogous respectively to FIGS. 3 to 6.
Figure 7:
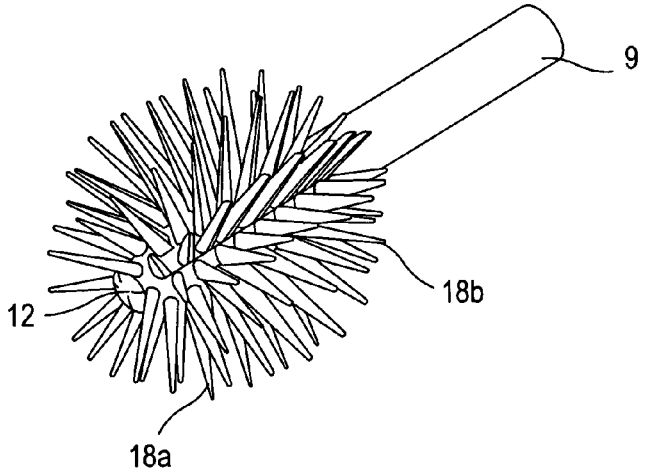

FIG. 9*c* is a diagram showing a variant embodiment in which the teeth 18*c* perpendicular to the longitudinal axis of the core are of varying height.

Figure 9:
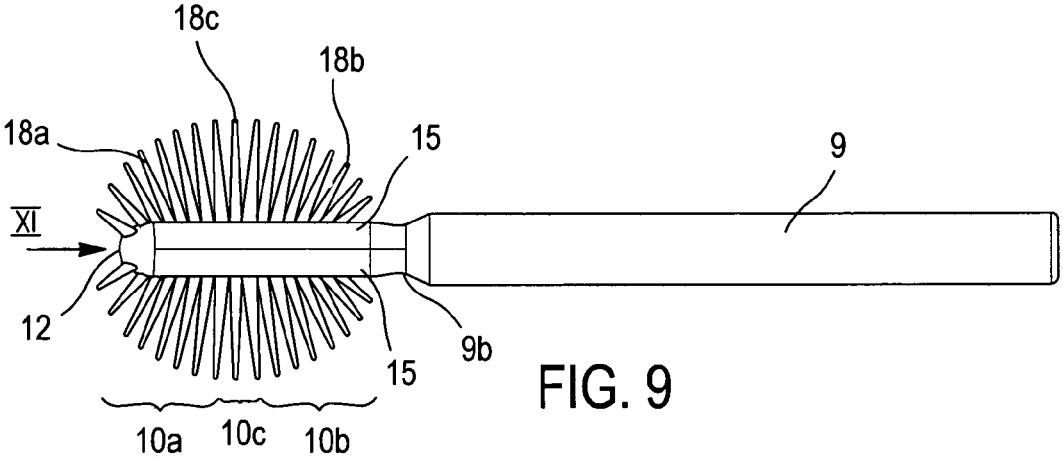
Figure 9D:
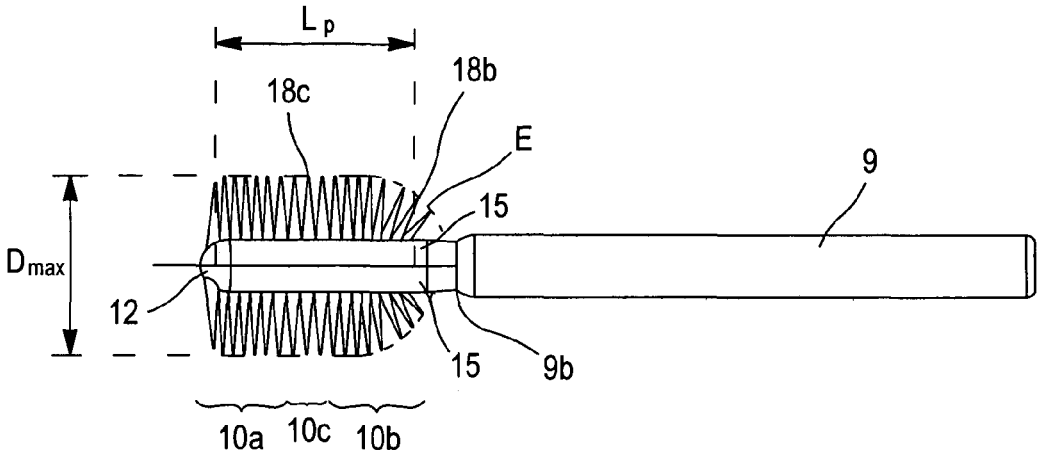

FIG. 9*d* is a diagram showing a variant embodiment in which there is a half-fan configuration towards the rear with teeth 18*c* situated on the side of the distal end and teeth 18*b* situated on the side of the proximal end.

All of the combinations described above and below concerning a half-fan towards the front on the side of the distal end and teeth perpendicular to the longitudinal axis of the core on the side of the proximal end apply equally to a half-fan towards the rear on the side of the proximal end and teeth perpendicular to the longitudinal axis of the core on the side of the distal end.

Figure 9E:
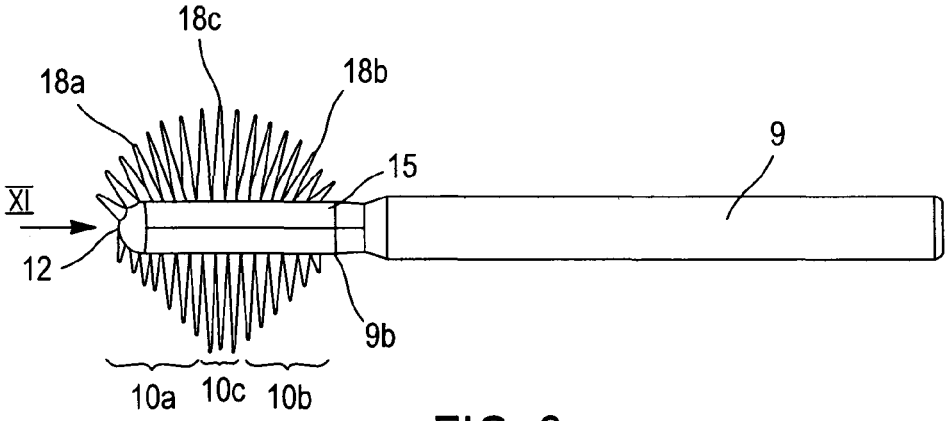

FIG. 9*e* is a diagram showing an embodiment in which at least one tooth 18*a* extending towards the front and at least one tooth 18*b* extending towards the rear are present on a portion of the core that is opposite from a portion that has only teeth 18*c* that are perpendicular to the longitudinal axis of the core. These teeth 18*c* are shown as being of varying length, but it should be understood that they could all be of the same length.

Figure 9F:
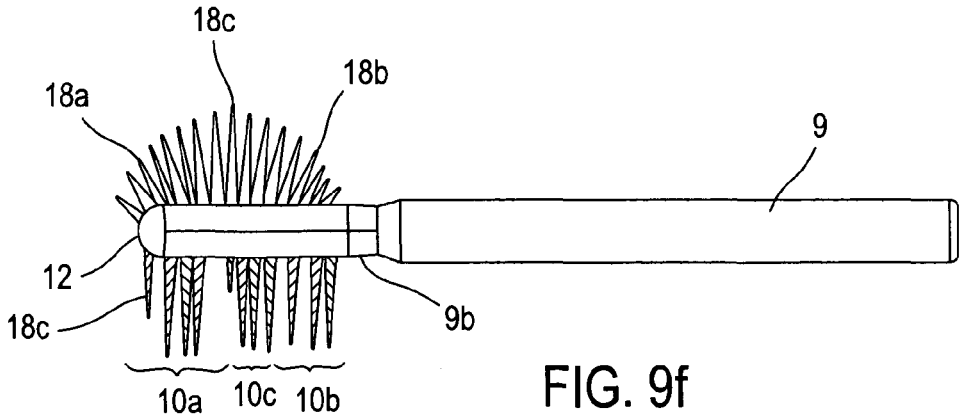

FIG. 9*f* is a diagram showing a variant embodiment in which at least one tooth 18*a* and at least one tooth 18*b* are present on a portion of the core opposite from a portion that has only teeth 18*c*. As shown, these teeth 18*c* may differ in at least one of their shape, length, material, hardness, spacing, or orientation.

Figure 9H:
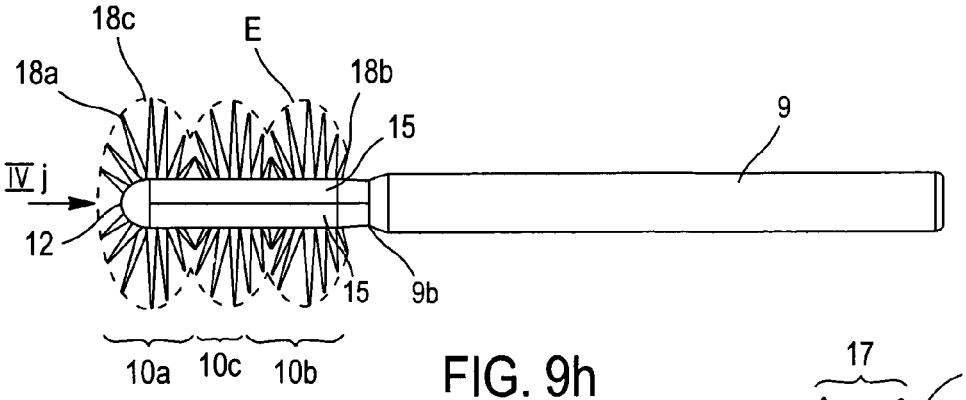
Figure 9J:
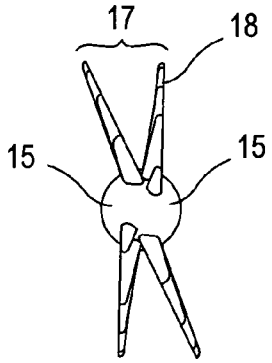
FIG. 9*j* is a diagrammatic face view looking along IXj of FIG. 9*h;*
Figure 9I:
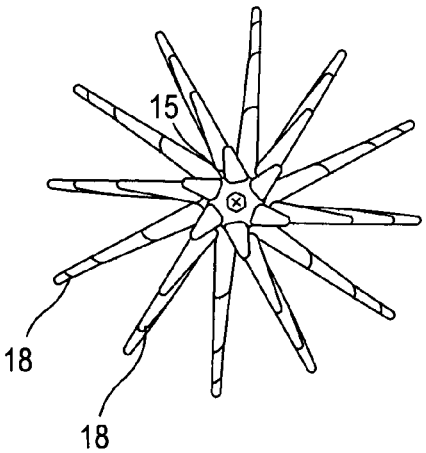
FIG. 9*i* corresponds to an embodiment of the invention.
Figure 9G:
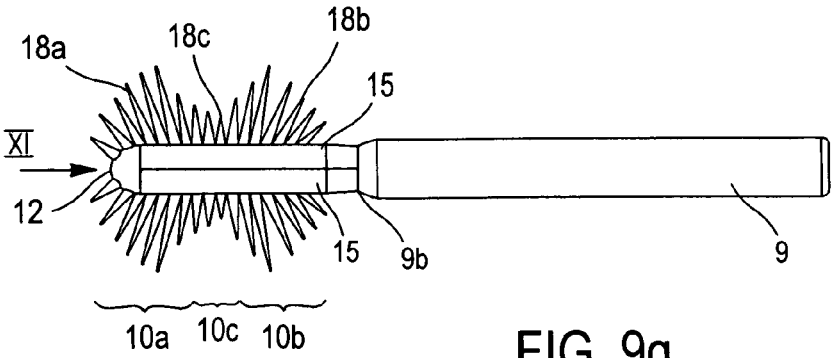
Figure 9K:
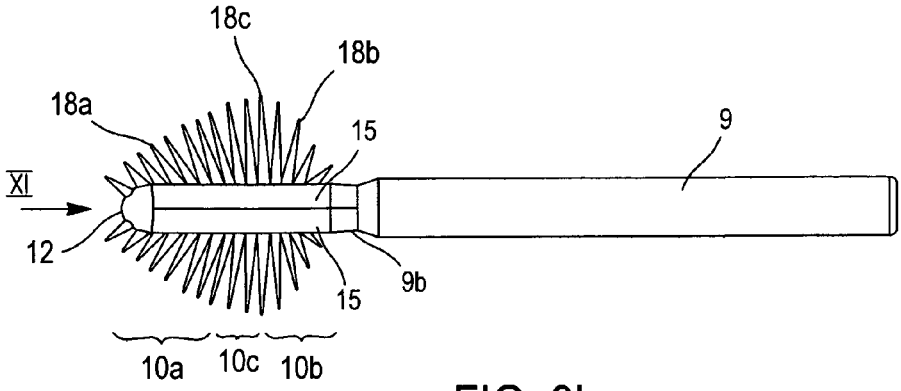
Figure 9M:
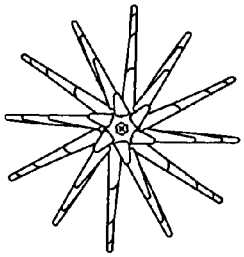
FIG. 9*m* corresponds to an embodiment of the invention.
Figure 9N:
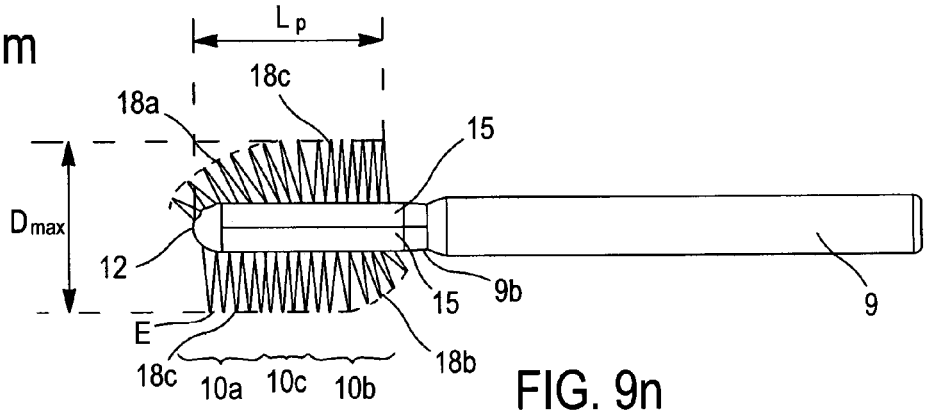
Figure 9L:
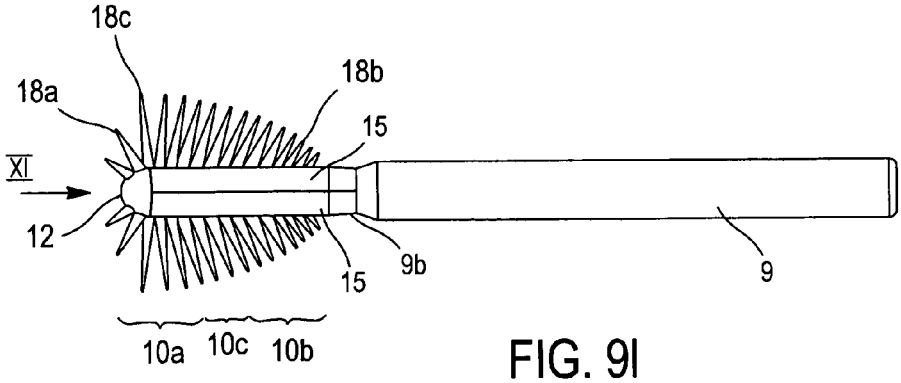
Figure 12:
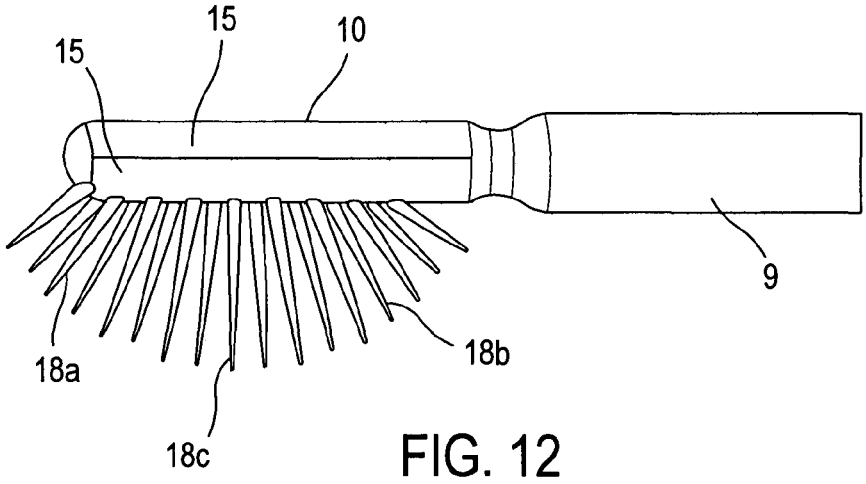
Figure 13:
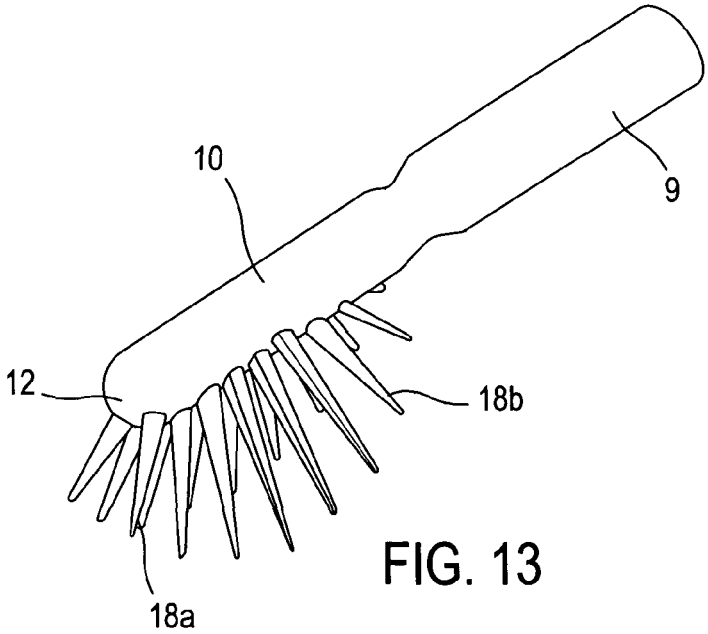
Figure 14:
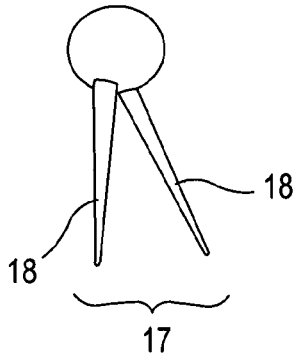

FIG. 9*n* is a non-limiting diagram showing a variant embodiment in which teeth in a half-fan configuration towards the front, situated beside the distal end, and at least one tooth 18*c* situated beside the proximal end are present on a portion of the core opposite from a portion containing teeth in a half-fan configuration towards the rear, situated beside the proximal end, together with at least one tooth 18*c* situated beside the distal end. The relative positions of the teeth in a half-fan configuration and the teeth perpendicular to the longitudinal axis of the core need not be restricted to the positions shown.

FIG. 9*h* is a diagram showing a multiple-fan configuration, the number of fans and their dispositions not being restricted to the example in the drawing. It is possible to have a multiple-fan configuration that is optionally symmetrical relative to the longitudinal axis of the core and/or specifically on applicator members as shown in FIGS. 3, 6, 9, and 12. In addition, FIG. 9*h* shows an envelope surface E of cross-section that has three maxima and two relative minima, thus presenting an undulating shape. Furthermore, FIG. 9*i* shows an embodiment in which the multiple fans together extend over the entire circumference of the core.

FIG. 9*k* shows an asymmetrical fan where the tooth (teeth) 18*c* is/are substantially closer to the proximal end than to the distal end. The example of FIG. 9*t* is analogous to that of FIG. 9*k* but differs in particular by the fact that the tooth (teeth) 18*c* perpendicular to the longitudinal axis of the core is/are substantially closer to the distal end than to the proximal end. FIG. 9*m* shows an embodiment in which the asymmetrical fans 9*k* and/or 9*l* extend over the entire circumference of the core. As for the multiple-fan configuration, it should be understood that such a disposition may be applied in particular to the applicator members of FIGS. 3, 6, 9, and 12.

Figure 6A:
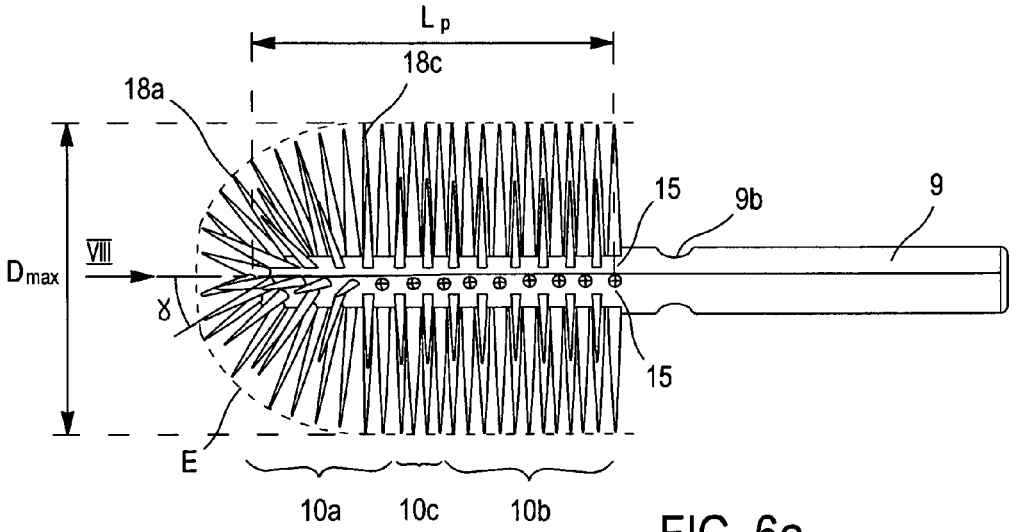
Figure 12A:
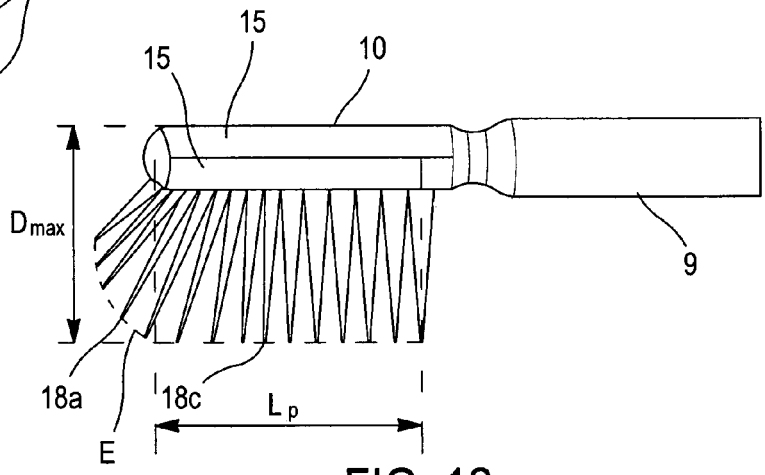

Furthermore, all of the variant embodiments described with reference to FIGS. 9*b*, 9*c*, and 9*d* can be adapted to other types of applicator member of the invention such as, for example, those shown in FIGS. 3*a*, 6*a*, and 12*a*.

Figure 58:
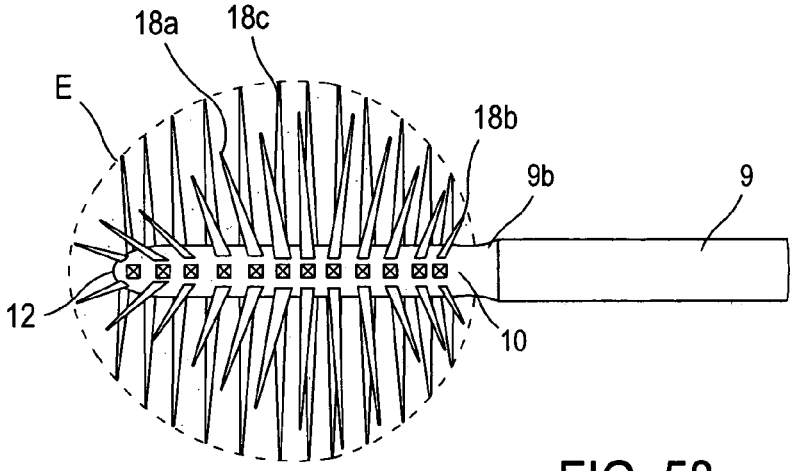
FIGS. 58 to 60 and 61 to 65 correspond to embodiments of the invention.
Figure 59:
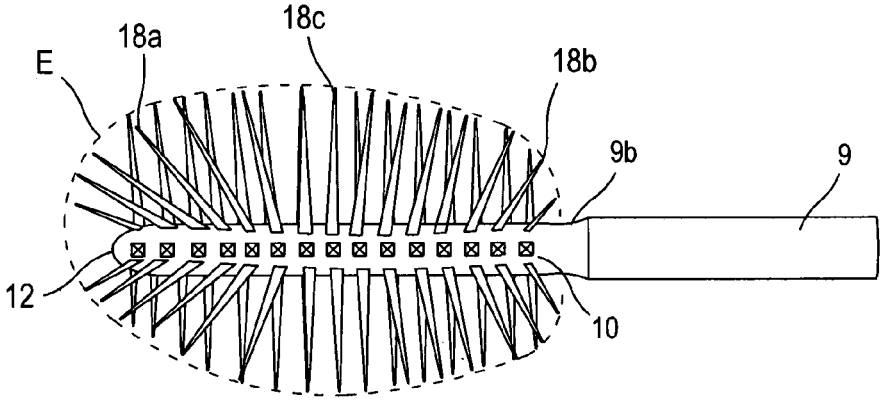
Figure 60:
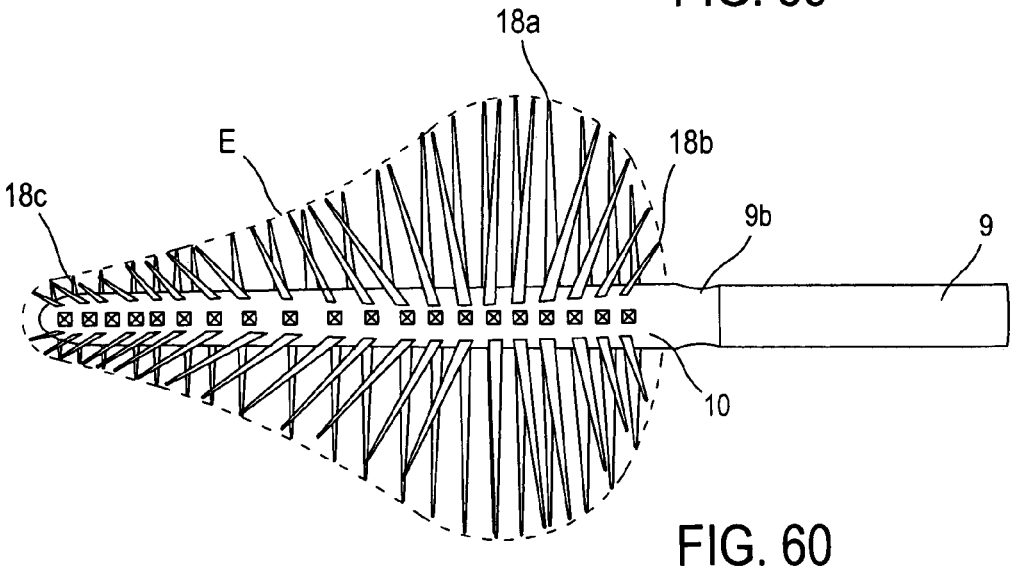

FIGS. 58 to 60 show embodiments that differ in envelope surface shape and in which there are rows of teeth that alternate around the circumference of the core between teeth 18*c* that are perpendicular to the longitudinal axis of the core and teeth in a fan configuration including at least one tooth 18*a* extending towards the front and at least one tooth 18*b* extending towards the rear. It should be understood that such configurations may be applied in particular to the applicators of FIGS. 3, 6, 9, and 12.

The envelope surface E in FIG. 58 is substantially circular in longitudinal section. The envelope surface E in FIG. 59 is substantially elliptical in shape. FIG. 60 is a diagram showing an example in which the cross-section of the envelope surface E increases and then decreases on moving along the core from the proximal end towards the distal end. Furthermore, the outline of the envelope surface E in longitudinal section may optionally include a point of inflection as shown. By way of example, the envelope surface E reaches it greatest transverse dimension on the side of the proximal portion of the applicator member.

Figure 61:
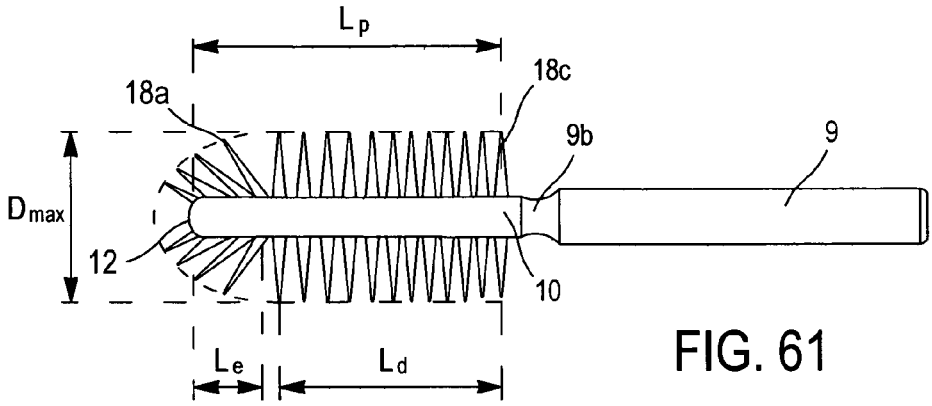
Figure 62:
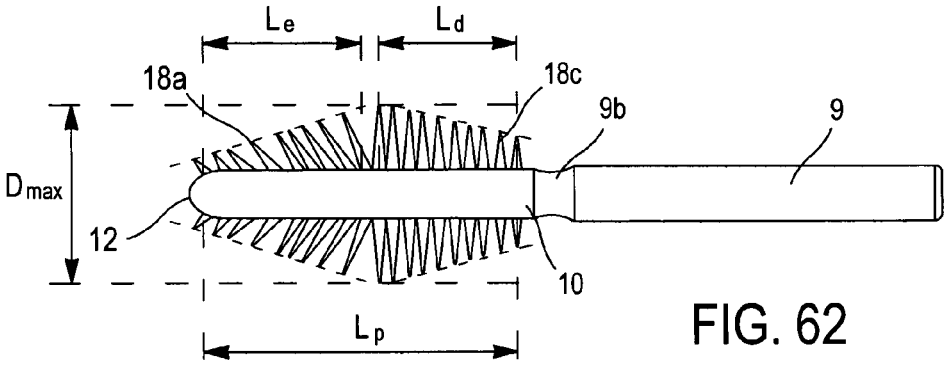
Figure 63:
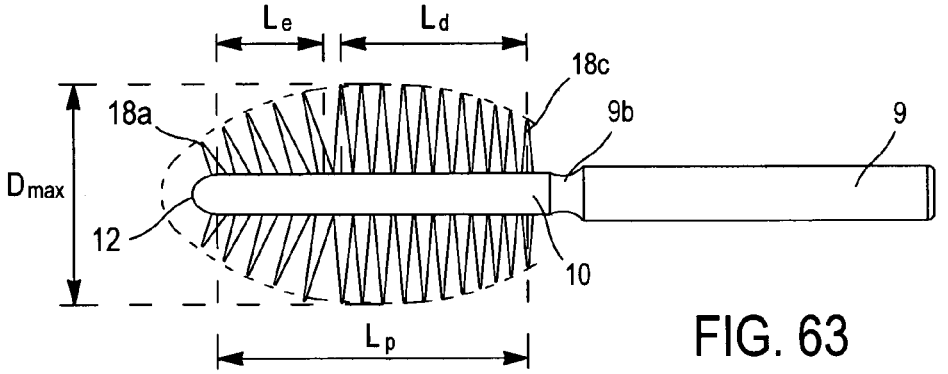
Figure 64:
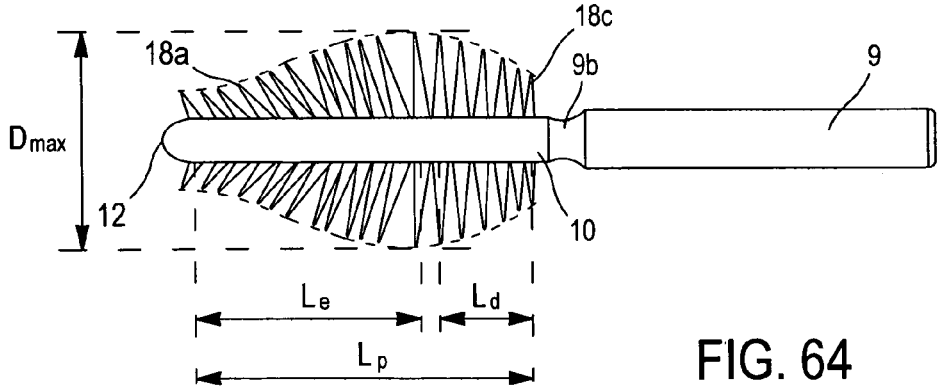
Figure 65:
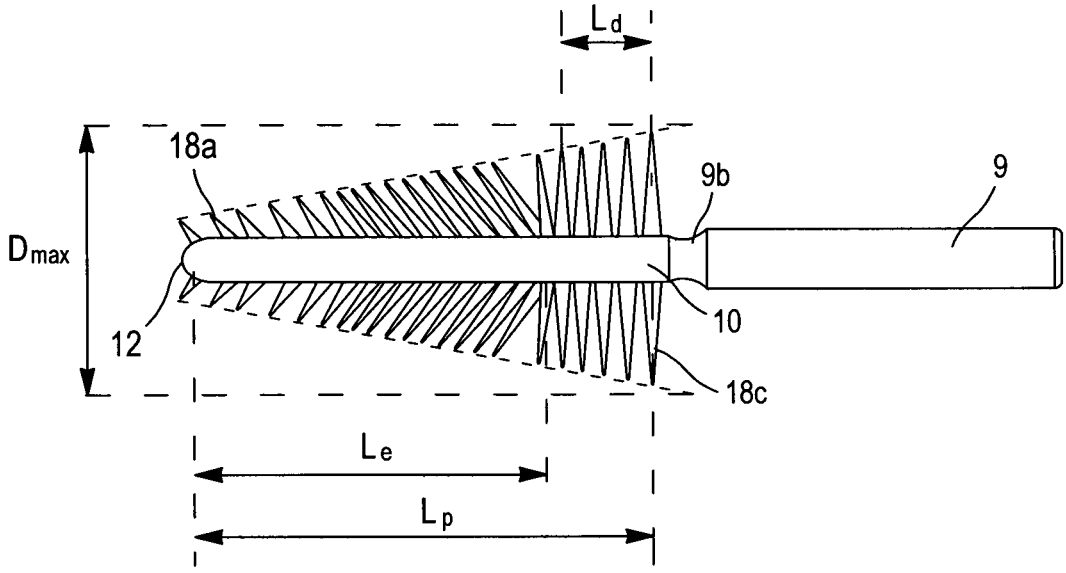

FIGS. 61 to 65 show embodiments analogous to that of FIG. 9*a*, in which the length $L_d$ of the core fraction occupied by teeth perpendicular to the longitudinal axis of the core varies relative to the length $L_e$ of the core fraction occupied by teeth extending obliquely. In FIG. 61, $L_e$ is substantially of the order of one-third of $L_d$. In FIG. 63, $L_e$ is substantially of the order of half $L_d$. In FIG. 62, $L_e$ is substantially of the same order as $L_d$. In FIG. 64, $L_e$ is substantially of the order of twice $L_d$. In FIG. 65, $L_e$ is substantially of the order of three times $L_d$. Naturally, such configurations may be applied in particular to the applicators of FIGS. 3*a*, 6*a*, 9*a*, and 12*a*.

In the embodiment of FIGS. 12 to 14, and 12*a* the core is of hexagonal cross-section and includes only one row of teeth extending from a single face 15 of the core 10, the other five faces 15 having no teeth at all.

In the embodiments described above, those faces that have no teeth at all, may, in variants that are not shown, be provided with teeth that are relatively short, e.g. of length lying in the range 0.5 mm to 1.8 mm.

The core may have an arbitrary number of longitudinal faces, with all of above-described characteristics being applicable regardless of the number of longitudinal faces.

Figure 15:
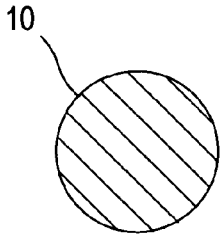
FIGS. 15 to 19 are diagrammatic and fragmentary cross-sections of embodiment variants.
Figure 16:
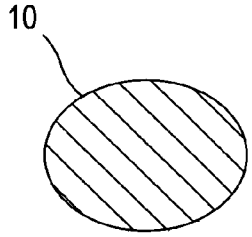
Figure 17:
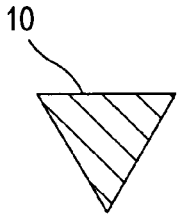
Figure 18:
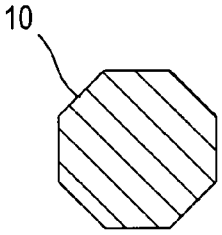
Figure 19:
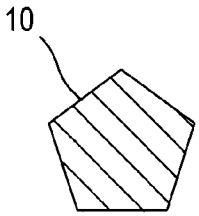

In another variant, the core 10 may present a cross-section that is circular, as shown in FIG. 15 or oval as shown in FIG. 16, or indeed triangular, octagonal, or pentagonal, as shown respectively in FIGS. 17, 18, and 19.

An applicator member 8 of the invention may have more than two teeth visible per longitudinal face when the core is observed along the longitudinal axis, and in addition to the first and second teeth 18 of the sets 20 and 30, it may include one or more additional teeth 18, e.g. at an angle greater than $\alpha$ relative to the direction $Z_1$, or indeed extending perpendicular to the corresponding face of the core.

It would not go beyond the ambit of the present invention if the teeth of the second set 30 of teeth were not inclined relative to the longitudinal face 15 of the core to which they are connected, and the directions $Z_1$ and $Z_2$ were parallel for each row 17.

In the above-described examples, the teeth of the first and second sets 20 and 30 of teeth 18 are located in a staggered configuration, their faces not being in alignment.

Figure 20:
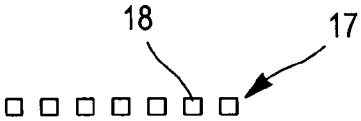

The configuration could be different and the bases of the teeth 18 could be in alignment, as shown in FIG. 20, a single line parallel to the longitudinal axis X of the core 10 intersecting all of the bases of the aligned teeth in the row, this line constituting the longitudinal axis of the row.

Figure 21:
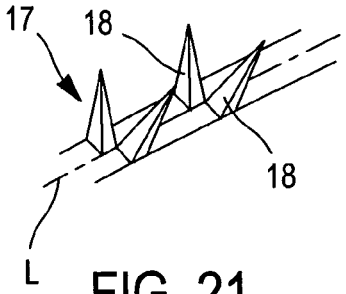
FIGS. 21, 23, and 25 are fragmentary perspective views of embodiment variants.

Two consecutive teeth of the row may define a V-shaped notch when the applicator is observed perpendicularly to its longitudinal direction, as shown in perspective in FIG. 21.

Figure 22:
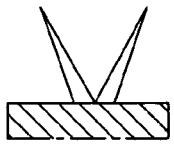
FIGS. 20, 22, 24, 26 to 28, and 52 are diagrammatic and fragmentary views of examples of tooth arrangements.

Two consecutive teeth of a row may also form a V-shape when the applicator member is observed along its longitudinal axis, as shown in FIG. 22.

Figure 52:
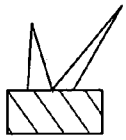
Figure 54:
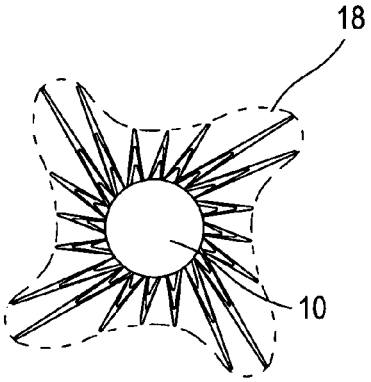
Figure 55:
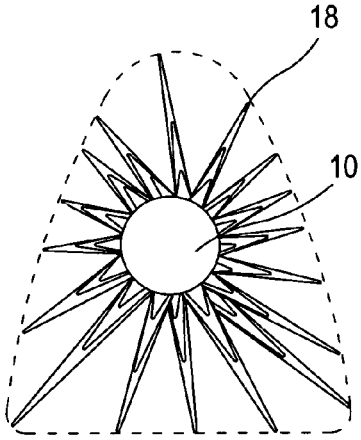
Figure 56:
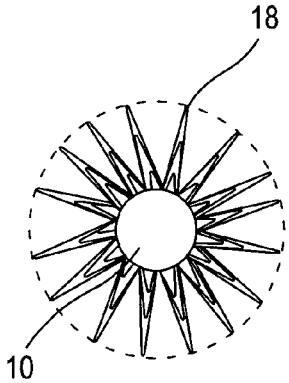
Figure 57:
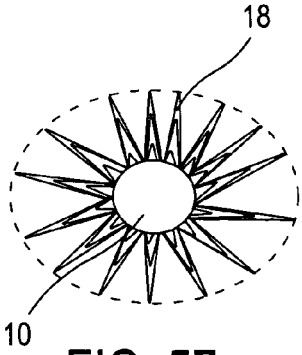

Two consecutive teeth of a row may form an off-center V-shape when the applicator member is observed along its longitudinal axis, as shown in FIG. 52.

Figure 23:
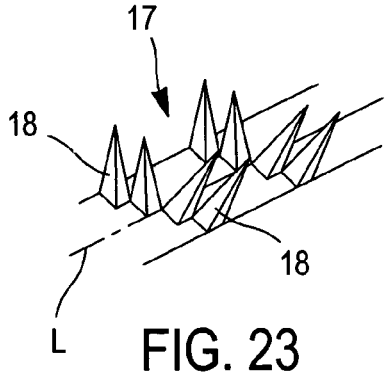
Figure 24:
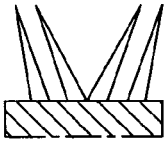

FIGS. 23 and 24 show that, within a row, the applicator may include patterns of four teeth in which the middle two teeth form a V-shape. The patterns of four teeth follow one another along the longitudinal axis of the row.

Figure 25:
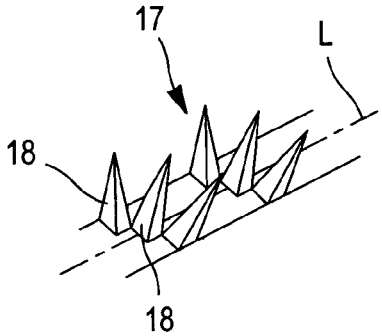
Figure 26:
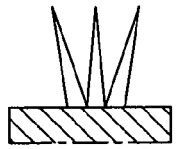

In the example shown in FIGS. 25 and 26, the row 17 has patterns of three consecutive teeth having two teeth forming a V-shape with a tooth between them. These teeth nevertheless constitute only a single row since they following one another along the longitudinal axis of the core.

Figure 27:
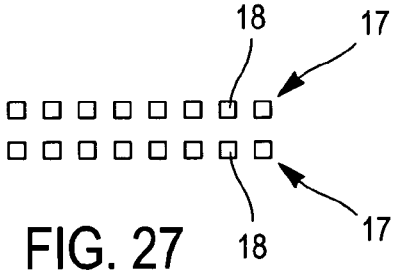
Figure 28:
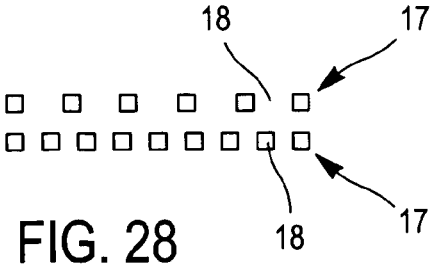

Two rows 17 of teeth of an applicator member 8 in accordance with the invention may also include teeth that are spaced apart from one another at the same spacing as shown in FIG. 27, or on the contrary at different spacings as shown in FIG. 28.

In FIGS. 53 to 57, the core is shown as having a cross-section that is circular, it being understood that sections of other shapes may be used.

Figure 53:
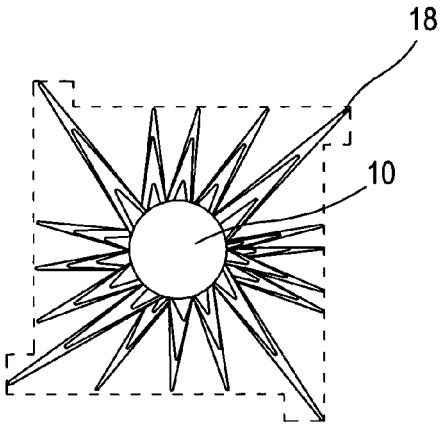
FIGS. 53 to 57 are diagrammatic cross-sections of various applicator members of the invention.

When the applicator member is seen in cross-section, the rows of teeth may form projecting lugs, as shown in FIG. 53.

FIGS. 54, 55, 56, and 57 show respectively rows that are cross-shaped, triangular, circular, and elliptical.

Within each row, the teeth may be grouped together in groups of teeth, e.g. in pairs of teeth. Naturally, the teeth could be grouped together other than in pairs, with the spacing between the groups of teeth within a given row being regular or otherwise, and in particular being greater than the mean spacing between the teeth within a group.

Furthermore, in the example of FIG. 5, each tooth 18 has a first longitudinal face 40 that is of plane shape, and a second longitudinal face 41 that is of rounded shape, in particular of convex shape.

Figure 29:
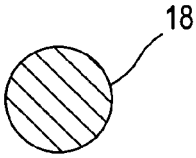
FIGS. 29 to 36 are cross-sections of teeth.
Figure 32:
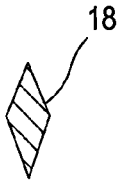
Figure 36:
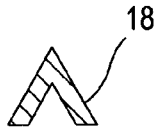
Figure 33:
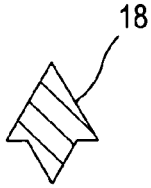
Figure 31:
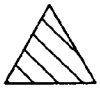
Figure 30:
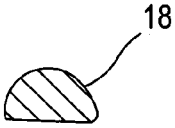
Figure 34:
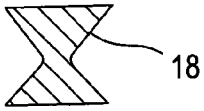
Figure 35:
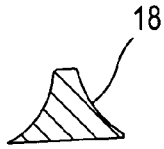

In a variant, and regardless of the way in which the teeth are implanted, at least one tooth may have a cross-section that is circular, as shown in FIG. 29, or semicircular as shown in FIG. 30, or indeed triangular as shown in FIG. 31, or lozenge-shaped as shown in FIG. 32, in the form of two touching triangles of different sizes as shown in FIG. 33, of diabolo-shape as shown in FIG. 34, of half-diabolo shape as shown in FIG. 35, or triangular with a groove, as shown in FIG. 36. The teeth are preferably of cross-section that is not circular. A non-circular shape for the cross-section of the teeth can encourage composition being retained by the teeth.

The longitudinal faces 15 of the core 10 need not be plane, for example they could be concave or convex over at least a fraction of their length. The core 10 may include longitudinal faces 15 that are concave at least in part, the concave shape being centered on a midplane of the core 10 intersecting it substantially halfway along, for example.

The concave shape of the longitudinal faces 15 may be formed by shrinking the cross-section of the core 10.

Figure 37:
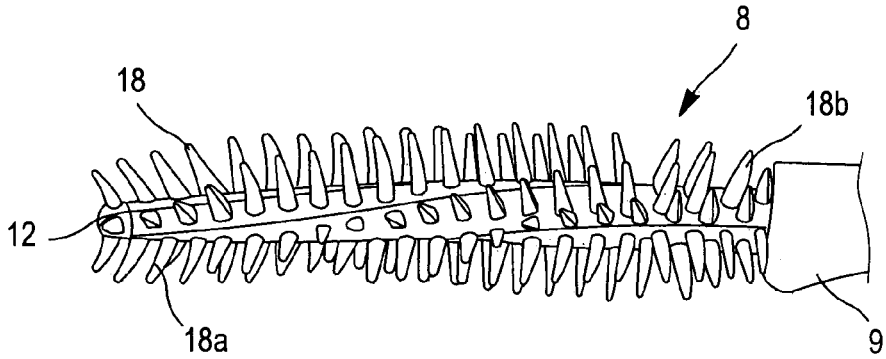
FIG. 37 is a perspective view of an embodiment variant.

In a variant embodiment, the longitudinal faces 15 of the core 10 are twisted, as shown in FIG. 37, i.e. the corresponding side follows at least one rotation going towards the distal end of the core.

In order to make such a shape, the core 10 may be deformed on being unmolded by rotating the endpiece 9, or in a variant it may be deformed in the mold.

Figure 38:
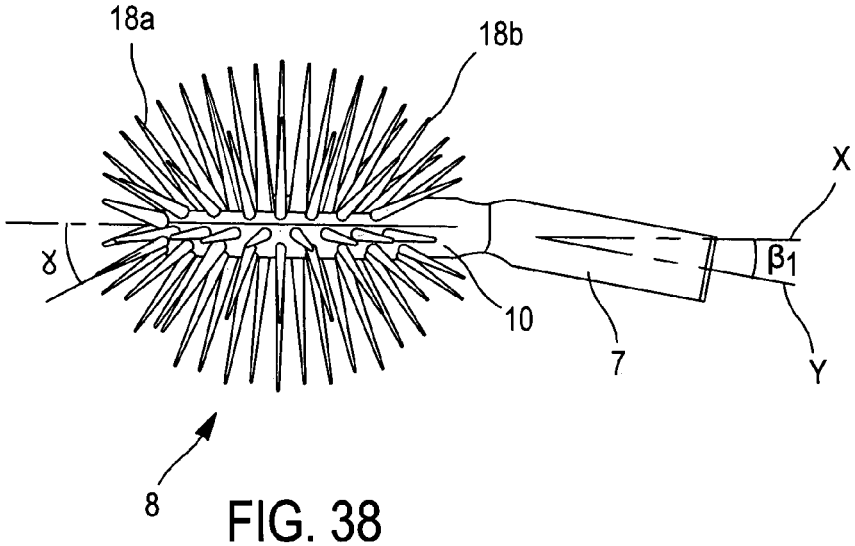
FIG. 38 is a view analogous to FIG. 3 showing another variant.

The longitudinal axis X of the core 10 may coincide with the longitudinal axis Y of the stem 7, however it would not go beyond the ambit of the present invention if the arrangement was otherwise, and by way of example FIG. 38 shows an embodiment variant in which the longitudinal axis X of the core 10 forms an angle $\beta_1$ with the longitudinal axis Y of the stem. Such a configuration may improve application by making the applicator easier to handle, for example.

Figure 39:
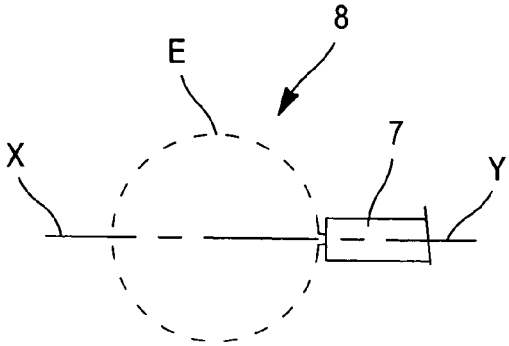
FIGS. 39 and 40 are diagrammatic views of the envelope surfaces of other embodiment variants.

In the variant shown in FIG. 39, the longitudinal axis X of the core 10 is rectilinear and the envelope surface E presents a circular shape.

Figure 40:
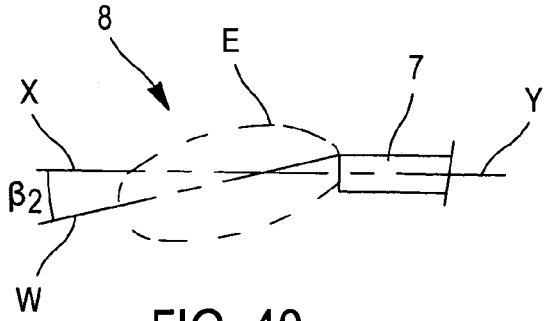

In another variant, as shown in FIG. 40, the free ends of the teeth 18 define an envelope surface E that extends generally along a longitudinal axis X forming an angle $\beta_2$ with the longitudinal axis X of the core 10, and the applicator member can be said to be eccentric.

Figure 41:
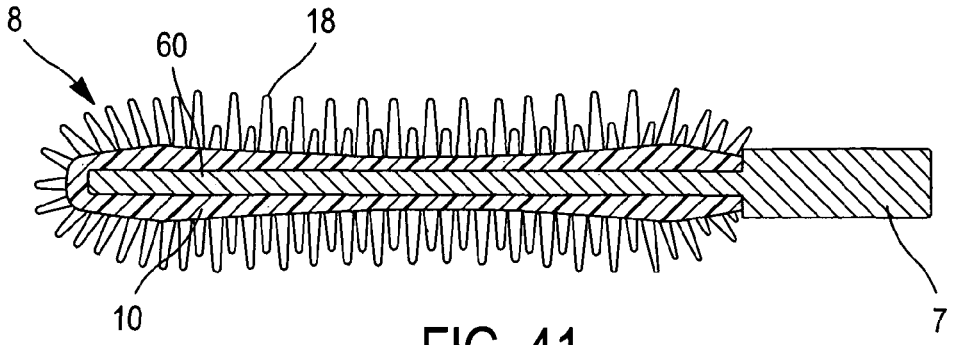
FIG. 41 is a fragmentary longitudinal section of an embodiment variant.
Figure 42:
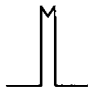
FIGS. 42 to 44 show embodiment variants of teeth.
Figure 44:
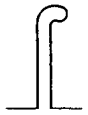
Figure 43:
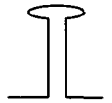

In a variant embodiment shown in FIG. 41, the core includes a recess in which a support portion 60 is engaged, e.g. a portion made of metal or of plastics material. The core may be configured so as to be stationary relative to the support 60, or it may be free to move in rotation or in translation relative to the support 60. By way of example, the core could also be molded onto the support 60.

The teeth of at least one of the rows may present different heights, e.g. passing through an extremum between the end teeth of the row.

At least one of the teeth 18 in the rows 17 may present a surface state that is not smooth, for example it may be molded with splines or roughness e.g. due to the presence of a filler in the plastics material.

The applicator member may be made out of a plastics material that includes magnetic particles. The magnetic field generated by such particles, which may be magnetizable and/or magnetized, may exert an effect on the eyelashes for example and may interact with magnetic fibers or pigments that may be present in the composition.

The applicator member may be made with flocking, the flocking extending for example on the teeth only or on the core only.

At their free ends, the teeth may present portions in relief or of a special shape, e.g. in the shape of a fork, a bead, or a hook, as shown in FIGS. 42 to 44 and 51. By way of example, the hook may extend across, along, or obliquely relative to the longitudinal axis X of the core. To obtain beads, the applicator member may be heated so as to melt the tips of the teeth. To obtain forks or hooks, the applicator member may be subjected to mechanical treatment, for example the applicator member may be subjected to grinding so as to abrade the ends.

The core and/or the teeth may also include particles, e.g. a filler, in particular of a compound that is magnetic, bacteriostatic, or moisture-absorbing, or indeed a compound for creating roughness on the surface of the tooth or for enhancing sliding of the eyelashes over the teeth.

Figure 49:
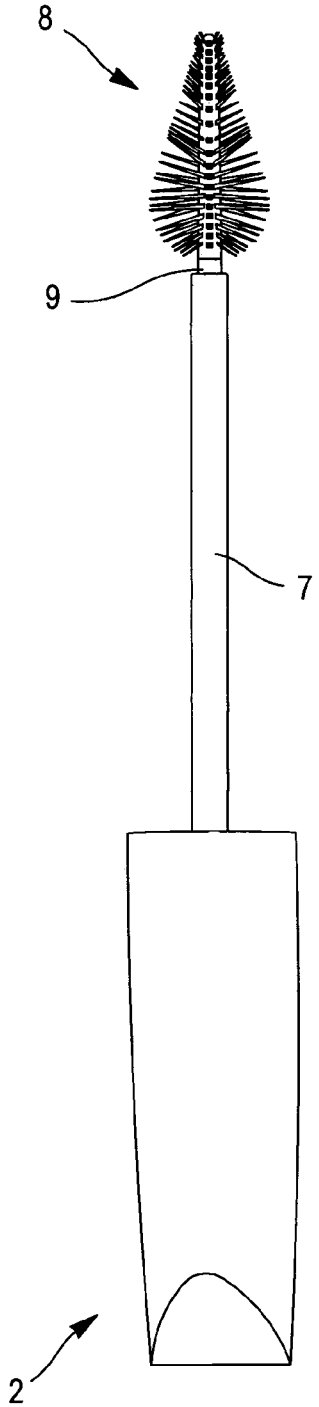
FIGS. 49 and 50 are diagrammatic views of examples of applicators of the invention.
Figure 50:
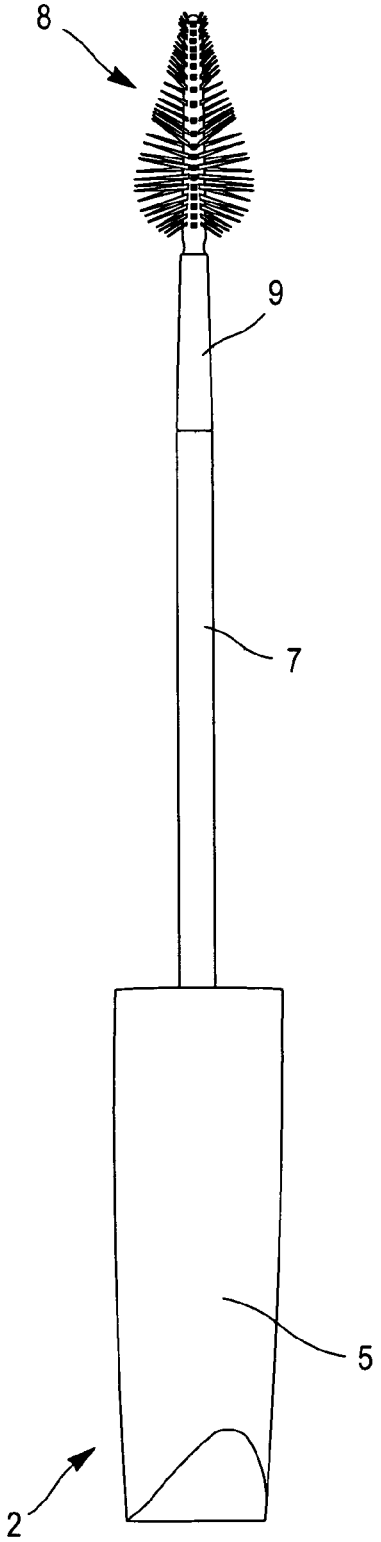
Figure 51:
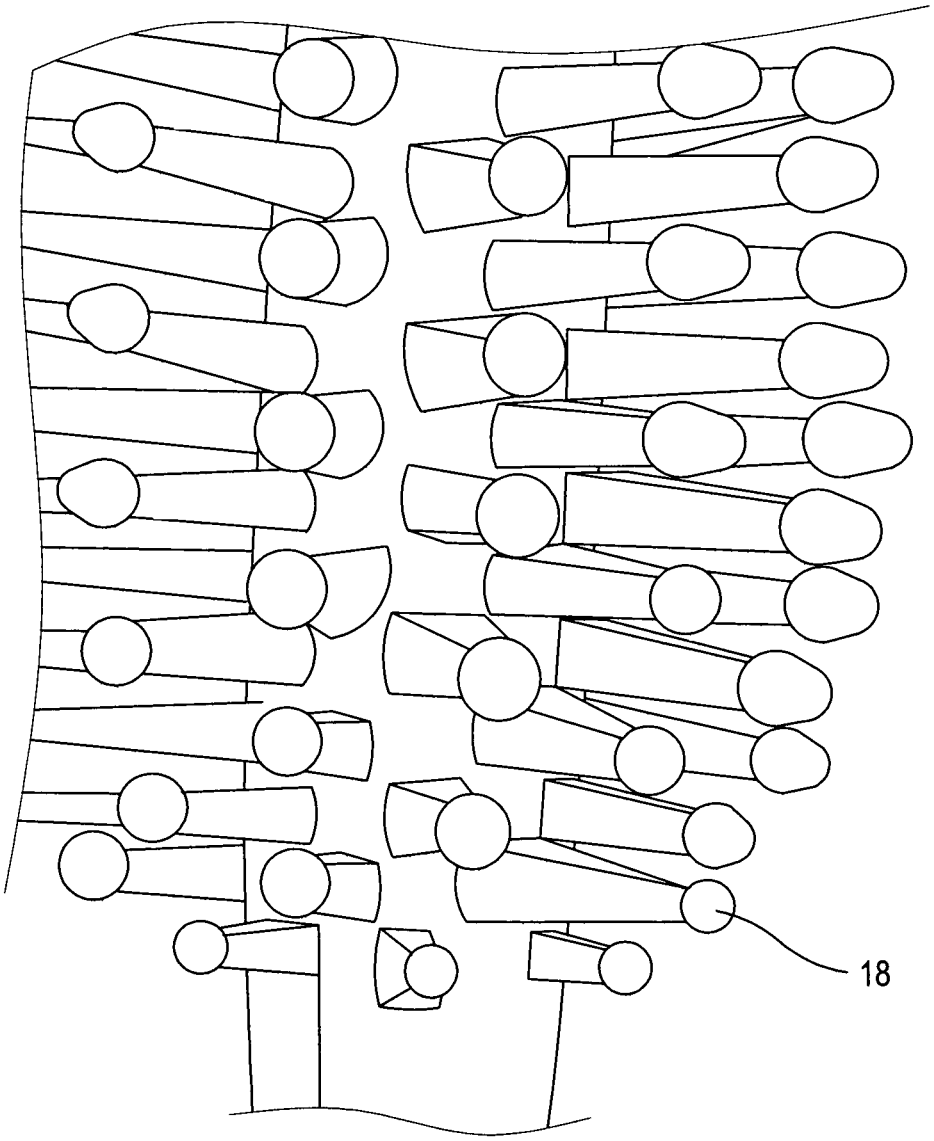
FIG. 51 is a diagrammatic view of an embodiment of an applicator member of the invention.

FIGS. 49 and 50 show two examples of an applicator 2 of the invention. Each applicator may comprise in particular a closure cap 5, a stem 7, an applicator member 8, which applicator member includes in particular an endpiece 9 enabling it to be fastened to the stem.

The rows 17 may have different numbers of teeth, one of the rows being shorter than another row, for example.

The wiper member may be made in some other way, for example it may comprise a block of foam, which block may be split. By way of example, the wiper member could also be as described in the following patent applications US 2005/0028834, U.S. Pat. No. 6,328,495, U.S. Pat. No. 6,375,374, US 2004/0258453, and US 2005/0175394, the content of which is incorporated herein by reference.

In particular, the wiper member may be rigid or it may be made of elastomer material.

Figure 45:
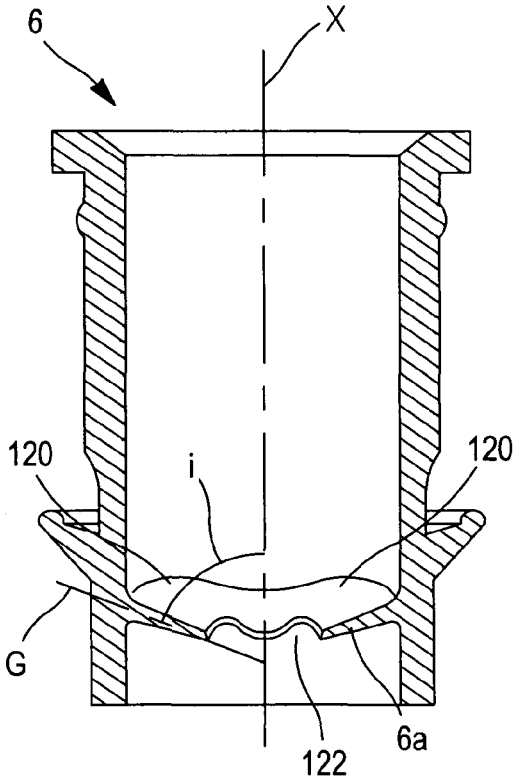
FIG. 45 is a diagrammatic and fragmentary cross-section of an embodiment variant of the wiper member.

The wiper lip 6*a* may advantageously be undulating, having a radially-inner free edge that defines a through orifice 122 for the applicator member, as shown in FIG. 45. The wiper lip 6*a* may include undulations 120 extending around the orifice 122. The wiper member 6*a* may have a number of undulations 120 that lies in the range 3 to 12, for example.

The wiper lip 6*a* may extend generally along a cone that converges towards the bottom of the container, having a generator line G making an angle i with the axis K of the container. In a variant, the wiper lip 6*a* may extend generally in a midplane perpendicular to the axis K, or indeed generally in a cone that converges towards the outlet from the container.

The wiper member may also be adjustable, where appropriate.

Figure 46:
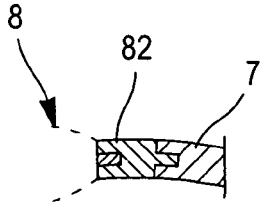
FIGS. 46 and 47 show details of embodiment variants of the stem.
Figure 47:
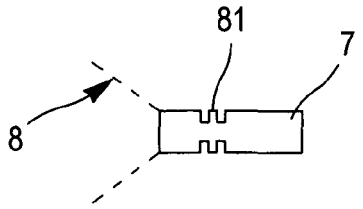

The stem 7 to which the core is fastened may be flexible, along its entire length, or at least in part, in particular close to the applicator member. By way of example, the stem may include at least one flexible element 80 as shown in FIG. 46, e.g. made of elastomer and/or with a shape that imparts flexibility, e.g. at least one notch 81 as shown in FIG. 47. By way of example, the flexible element may be flocked and may also serve to apply the composition.

To use the device 1, the user may unscrew the closure cap 5 and extract the applicator member 8 from the container 3.

After the applicator member 8 has gone through the wiper member 6, a certain quantity of composition remains between the rows 17 and between the teeth 18 of the rows, and can be applied by the user to the eyelashes or to the eyebrows.

The relatively large number of teeth and the way they are located on the applicator member enable makeup to be applied with care.

The applicator member may be made by any known method, such as in particular injection molding, dual injection, i.e. injecting two materials into the same mold, and also protrusion in which material is injected through at least a portion of the core so as to enable the teeth to be formed.

In addition, the applicator member may present one or more portions that are free relative to a kernel, in other words said portion(s) is/are not fastened or attached to the kernel. Clearance may separate the free portion(s) of the applicator member from the kernel. This enables the free portion(s) to move, even significantly, relative to the kernel when a force is applied to its outside surface of the applicator member, in particular by hand. The applicator member may include a free portion capable of being stretched or turned about the core. The kernel may be a metal pin fastened to the stem and the core may include a free portion that is movable relative to the pin.

While makeup is being applied to the eyelashes or the eyebrows, the applicator member may optionally be turned about the axis X. In the presence of teeth that are oriented obliquely on the applicator member, the teeth may be directed towards the eyelashes while makeup is being applied.

In another variant, the applicator member may be a vibrator member, i.e. vibration may be applied thereto during application, combing, or taking of the composition, for example as described in application WO 2006/090343.

In another variant, the applicator member may be rotatable, i.e. it may be caused to move in rotation in particular about the longitudinal axis of the core, e.g. during application, combing, or taking of the composition.

In another variant, the applicator member may be a heater member, i.e. it may include a heater element.

It is also possible for the applicator member to vibrate, turn, and be heated, or only to vibrate and turn, or only to vibrate and be heated, or only to be turned and be heated, or only to vibrate, or only to turn, or only to be heated.

Naturally, the invention is not limited to the above-described embodiment examples, and their characteristics may be combined to constitute variants that are not shown.

In the invention, the envelope surface is of varying cross-section and it passes through at least one maximum. In a particular embodiment of the invention, this maximum cross-section of the envelope surface of the applicator member may occupy at least 70% of an inside section of the container, at least along a portion of the path followed by the applicator member while it is being extracted from the container, with the height of this portion being not less than twice the length of the applicator member, e.g. lying in the range 2 to 10 times the length of the applicator member.

The maximum cross-section of the envelope surface of the applicator member may lie in the range 70% to 120% of the inside section of the container over said height, so as to create a piston effect.

Under such circumstances, the container may define an inside space containing the composition of height that may be at least twice the length of the applicator member.

The device may include at least two containers containing compositions that are identical or different, each having a removable closure cap and an applicator member. The two applicator members may differ from each other, for example one may have a twisted-core brush. The two containers may be united by a coupling member, e.g. one in line with the other, and the coupling member may be elastically deformable.

The applicator member may include any bactericidal agent such as salts of silver, copper, preservatives such as at least one composition-preserving agent such as parabens or other preservatives.

The term "comprising a" should be understood as being synonymous with the term "comprising at least one" unless specified to the contrary, and "lying in the range" should be understood as including the limits of the range, unless specified to the contrary.

The invention claimed is:

1. An applicator for combing keratinous fibers and/or for applying a composition on the keratinous fibers, the applicator comprising a molded applicator member that comprises:

a core extending along a longitudinal axis between front and rear ends;

teeth extending outwards from the core, each tooth extending from a respective base towards a respective free end, said base being in contact with the core, the core presenting a greatest transverse dimension measured perpendicularly to the longitudinal axis of the core, that is less than or equal to a greatest length of the teeth; and at least one tooth extending from a respective base of the at least one tooth towards the front end and at least one second tooth extending from a respective base of the at least one second tooth towards the rear end of the applicator;

the at least one tooth extending towards the front end and the at least one second tooth extending towards the rear end of the applicator each making a non-zero angle θ other than 90° relative to the longitudinal axis of the core, wherein the at least one tooth and the at least one second tooth are aligned along a linear axis parallel to the longitudinal axis, and wherein the teeth extending outwards from the core include a plurality of fanning teeth, each fanning tooth extends from a base of the respective fanning tooth along a respective direction of elongation and each fanning tooth makes an angle with the longitudinal axis of the core and wherein on moving along the longitudinal axis of the core, the angles formed between the directions of elongation of each of the fanning teeth and the longitudinal axis increase and then decrease.

2. An applicator according to claim 1, wherein the teeth extending outwards from the core include at least three teeth extending along respective directions of elongation, each making an angle with the longitudinal axis of the core, said angle having a different value for each of said three teeth.

3. An applicator according to claim 1, including at least one tooth of the applicator extending perpendicularly to the longitudinal axis.

4. An applicator according to claim 1, including at least one tooth of the applicator that extends parallel to the longitudinal axis of the core.

5. An applicator according to claim 4, said at least one tooth that extends parallel to the longitudinal axis of the core being located at a distal end of the core.

6. An applicator according to claim 1, wherein the core has a length as measured along the longitudinal axis that is less than or equal to 25 mm.

7. An applicator according to claim 1, wherein the greatest transverse dimension of the core measured perpendicularly to its longitudinal axis lies in a range of 1.5 mm to 3 mm.

8. An applicator according to claim 1, wherein the core is generally in the form of a body of revolution.

9. An applicator according to claim 1, wherein the longitudinal axis of the core is rectilinear.

10. An applicator according to claim 1, the applicator member comprising an endpiece integrally molded with the core and fastened to a stem that is connected to a handle of the applicator.

11. An applicator according to claim 10, the endpiece extending over a length as measured parallel to the longitudinal axis that lies in a range of 5 mm to 50 mm.

12. An applicator according to claim 10, wherein a greatest transverse dimension of the endpiece is greater than the greatest transverse dimension of the core.

13. An applicator according to claim 1, free ends of the teeth of the applicator member defining an envelope surface of the applicator member, the envelope surface when observed perpendicularly to the longitudinal axis of the core, having a shape that is one of circular, oval, oblong, and ellipsoidal.

14. An applicator according to claim 1, the teeth of the applicator member comprising a longest tooth of length as measured from the core along the direction of elongation of the tooth that lies in a range of 1.7 mm to 4.5 mm.

15. An applicator for combing keratinous fibers and/or for applying a composition on the keratinous fibers, the applicator comprising a molded applicator member that comprises:

a core extending along a longitudinal axis between front and rear ends;

teeth extending outwards from the core, each tooth extending from a respective base towards a respective free end, said respective base being in contact with the core, the core presenting a greatest transverse dimension measured perpendicularly to the longitudinal axis of the core, that is less than or equal to a greatest length of the teeth, and at least one perpendicular tooth having a base and extending perpendicularly to the longitudinal axis of the core and a plurality of oblique teeth, each oblique tooth having a respective base and extending from the respective base of each oblique tooth towards the front end or towards the rear end in an oblique manner, each of the oblique teeth extending from its respective base towards a free end, and a length of the core on which the oblique teeth extend being greater than a greatest transverse dimension of an envelope surface of the applicator member, the oblique teeth each extending along a respective direction of elongation towards the front end or towards the rear end in an oblique manner, said teeth making a non-zero angle other than 90° relative to the longitudinal axis of the core, wherein on moving along the longitudinal axis of the core towards the front end or the rear end of the core, angles formed between the directions of elongation of each of the teeth extending outwards from the core and the longitudinal axis decrease, and wherein each tooth is aligned along a linear axis parallel to the longitudinal axis.

* * * * *